US011091960B2

(12) United States Patent
Zhang et al.

(10) Patent No.: US 11,091,960 B2
(45) Date of Patent: Aug. 17, 2021

(54) PLACEMENT OF NON-PLANAR CUTTING ELEMENTS

(71) Applicant: SMITH INTERNATIONAL, INC., Houston, TX (US)

(72) Inventors: Youhe Zhang, Spring, TX (US); Xiaoge Gan, Houston, TX (US); Huimin Song, Spring, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 130 days.

(21) Appl. No.: 16/009,294

(22) Filed: Jun. 15, 2018

(65) Prior Publication Data

US 2018/0291691 A1 Oct. 11, 2018

Related U.S. Application Data

(63) Continuation of application No. PCT/US2016/063710, filed on Nov. 24, 2016, and a continuation of application No. PCT/US2016/063711, filed on Nov. 24, 2016.

(60) Provisional application No. 62/269,769, filed on Dec. 18, 2015, provisional application No. 62/269,780, filed on Dec. 18, 2015.

(51) Int. Cl.
*E21B 10/43* (2006.01)
*E21B 10/567* (2006.01)

(52) U.S. Cl.
CPC ..... *E21B 10/5673* (2013.01); *E21B 10/43* (2013.01)

(58) Field of Classification Search
CPC ..... E21B 10/5673; E21B 10/43; E21B 2010/425; E21B 10/42
See application file for complete search history.

(56) References Cited

U.S. PATENT DOCUMENTS 5,033,560 A 7/1991 Sawyer et al.
5,238,075 A 8/1993 Keith et al.
(Continued)

FOREIGN PATENT DOCUMENTS

CN 204782784 U 11/2015

OTHER PUBLICATIONS

First Office Action and Search Report issued in Chinese patent application 201680077569.5 dated Aug. 5, 2019, 24 pages.
(Continued)

*Primary Examiner* — Daniel P Stephenson

(57) ABSTRACT

A downhole cutting tool includes a tool body having a tool axis, and a blade extending from the tool body. The blade includes a cutting face, a trailing face, and a top face extending between the cutting face and the trailing face. Cutting elements are attached to the bade along the cutting face, with each having a cutting crest at a peak height and a reduced height extending laterally away from the cutting crest. In some cases, first cutting elements along the cutting face and second cutting elements along the top face and rearward from, and at the same radial position as, the first cutting elements have different size, orientation, geometry or material properties. In additional aspects, at least two cutting elements on the blade have differing material properties, sizes, orientations, or working surface geometries along a blade profile of the blade.

20 Claims, 17 Drawing Sheets

(56) References Cited

U.S. PATENT DOCUMENTS

| | | | | |
|---|---|---|---|---|
| 8,122,980 | B2 * | 2/2012 | Hall | E21B 10/55 175/432 |
| 8,887,837 | B2 * | 11/2014 | Azar | E21B 10/567 175/426 |
| 10,309,156 | B2 * | 6/2019 | Azar | E21B 10/5673 |
| 2006/0180356 | A1 * | 8/2006 | Durairajan | G06F 30/20 175/431 |
| 2007/0205023 | A1 * | 9/2007 | Hoffmaster | E21B 17/1092 175/408 |
| 2008/0105466 | A1 | 5/2008 | Hoffmaster et al. | |
| 2008/0179108 | A1 | 7/2008 | McClain et al. | |
| 2008/0302575 | A1 | 12/2008 | Durairajan et al. | |
| 2010/0155149 | A1 | 6/2010 | Keshavan et al. | |
| 2010/0326742 | A1 | 12/2010 | Vempati et al. | |
| 2012/0205163 | A1 | 8/2012 | Azar et al. | |
| 2013/0168159 | A1 * | 7/2013 | Eyre | B22F 3/14 175/432 |
| 2014/0130418 | A1 * | 5/2014 | Bao | B24D 18/0009 51/297 |
| 2014/0262544 | A1 | 9/2014 | Azar et al. | |
| 2014/0262545 | A1 * | 9/2014 | Azar | E21B 10/5673 175/430 |
| 2015/0259988 | A1 | 9/2015 | Chen et al. | |

OTHER PUBLICATIONS

Shunhui et al., Manufacture and Application of PDC Bit Enhanced by Special Diamond-Impregnated Segment, Petroleum Drilling Techniques, col. 42, No. 6, Nov. 2014, 4 pages.

International Search Report and Written Opinion issued in International Patent Application No. PCT/US2016/063711 dated Mar. 13, 2017, 16 pages.

International Search Report and Written Opinion issued in International Patent Application No. PCT/US2016/063710 dated Mar. 6, 2017, 15 pages.

International Preliminary Report on Patentability issued in International Patent Application No. PCT/US2016/063711 dated Jun. 19, 2018, 12 pages.

International Preliminary Report on Patentability issued in International Patent Application No. PCT/US2016/063710 dated Jun. 19, 2018, 11 pages.

Second Office Action and Search Report issued in Chinese patent application 201680077569.5 dated Jul. 3, 2020, 19 pages.

Third Office Action and Search Report issued in Chinese patent application 201680077569.5 dated Jan. 27, 2021.

Fourth Office Action issued in Chinese patent application 201680077569.5 dated May 8, 2021, 24 pages.

* cited by examiner

PLACEMENT OF NON-PLANAR CUTTING ELEMENTS

CROSS-REFERENCE TO RELATED PATENT APPLICATIONS

This application is a continuation of International Patent Application No. PCT/US2016/063710, filed Nov. 24, 2016, which claims the benefit of U.S. patent application Ser. No. 62/269,769, filed Dec. 18, 2015. This application is also a continuation of International Patent Application No. PCT/US2016/063711, filed Nov. 24, 2016, which claims the benefit of, and priority to, U.S. patent application Ser. No. 62/269,780, filed Dec. 18, 2015. Each of the foregoing is expressly incorporated herein by this reference in its entirety.

BACKGROUND

There are several types of downhole cutting tools, such as drill bits, including roller cone bits, hammer bits, and drag bits, reamers and milling tools. Roller cone rock bits include a bit body adapted to be coupled to a rotatable drill string and include at least one "cone" that is rotatably mounted to a cantilevered shaft or journal. Each roller cone in turn supports a plurality of cutting elements that cut and/or crush the wall or floor of the borehole and thus advance the bit. The cutting elements, either inserts or milled teeth, contact with the formation during drilling. Hammer bits generally include a one piece body having a crown. The crown includes inserts pressed therein for being cyclically "hammered" and rotated against the earth formation being drilled.

Drag bits, often referred to as "fixed cutter drill bits," include bits that have cutting elements attached to the bit body, which may be a steel bit body or a matrix bit body formed from a matrix material such as tungsten carbide surrounded by a binder material. However, there are different types and methods of forming drag bits that are known in the art. For example, drag bits having abrasive material, such as diamond, impregnated into the surface of the material which forms the bit body are commonly referred to as "impreg" bits. Drag bits having cutting elements made of an ultra hard cutting surface layer or "table" (generally made of polycrystalline diamond material or polycrystalline boron nitride material) deposited onto or otherwise bonded to a substrate are known in the art as polycrystalline diamond compact ("PDC") bits.

An example of a drag bit having a plurality of cutting elements with ultra hard working surfaces is shown in FIG. 1. The drill bit 100 includes a bit body 110 having a threaded upper pin end 111 and a cutting end 115. The cutting end 115 generally includes a plurality of ribs or blades 120 arranged about the rotational axis (also referred to as the longitudinal or central axis) of the drill bit and extending radially outward from the bit body 110. Cutting elements, or cutters, 150 are embedded in the blades 120 at predetermined angular orientations and radial locations relative to a working surface and with a desired back rake angle (i.e., a vertical orientation) and side rake angle (i.e., a lateral orientation) against a formation to be drilled.

FIG. 2 shows an example of a cutting element 150, where the cutting element 150 has a cylindrical cemented carbide substrate 152 having an end face or upper surface referred to herein as a substrate interface surface 154. An ultrahard material layer 156, also referred to as a cutting layer, has a top surface 157, also referred to as a working surface, a cutting edge 158 formed around the top surface, and a bottom surface, referred to herein as an ultrahard material layer interface surface 159. The ultrahard material layer 156 may be a polycrystalline diamond or polycrystalline cubic boron nitride layer. The ultrahard material layer interface surface 159 is bonded to the substrate interface surface 154 to form an interface between the substrate 152 and ultrahard material layer 156.

SUMMARY

This summary is provided to introduce a selection of concepts that are further described below in the detailed description. This summary is not intended to identify key or essential features of the claimed subject, nor is it intended to be used as an aid in limiting the scope of the claimed subject matter.

In one aspect, embodiments of the present disclosure relate to a downhole cutting tool that includes a tool body having a tool axis, at least one blade extending from the tool body including a cutting face, a trailing face, and a top face extending between the cutting face and the trailing face, a first cutting element attached to the at least one blade along the cutting face and a second cutting element attached to the at least one blade along the top face, rearward from and at the same radial position from the tool axis as the first cutting element. A working surface of each of the first and the second cutting elements has a cutting crest at a peak height and a reduced height extending laterally away from the cutting crest and the first cutting element has a different size, orientation, geometry, or material properties from the second cutting element.

In another aspect, embodiments of the present disclosure relate to a downhole cutting tool that includes a tool body having a tool axis, at least one blade extending from the tool body including a cutting face, a trailing face, and a top face extending between the cutting face and the trailing face, a first plurality of cutting elements attached to the at least one blade along the cutting face and a second plurality of cutting elements attached to the at least one blade along the top face, rearward from and radially between the first plurality of cutting elements. A working surface of each of the first plurality of cutting elements and the second cutting element has a cutting crest at a peak height and a reduced height extending laterally away from the cutting crest.

In yet another aspect, embodiments of the present disclosure relate to a downhole cutting tool that includes a tool body, at least one blade extending from the tool body including a cutting face, a trailing face, and a top face extending between the cutting face and the trailing face, a first plurality of cutting elements attached to the at least one blade along the cutting face and a second plurality of cutting elements attached to the at least one blade along the top face, rearward from the first plurality of cutting elements. A working surface of each of the first and the second plurality of cutting elements has a cutting crest at a peak height and a reduced height extending laterally away from the cutting crest, and at least one of the first plurality of cutting elements and at least one of the second plurality of cutting elements on the at least one blade have differing material properties, sizes, orientations, and/or working surface geometries.

In one aspect, embodiments of the present disclosure relate to a downhole cutting tool that includes a tool body, at least one blade extending from the tool body, the at least one blade having a cutting face, a trailing face and a top face extending between the cutting face and trailing face, a plurality of cutting elements attached to the at least one blade along the cutting face, a working surface of each of the plurality of cutting elements having a cutting crest at a peak height and a reduced height extending laterally away from the cutting crest. At least two of the plurality of cutting elements on the at least one blade have differing material properties, sizes, orientations, and/or working surface geometries along a blade profile of the at least one blade.

In another aspect, embodiments of the present disclosure relate to a downhole cutting tool that includes a tool body having a tool axis, at least one blade extending from the tool body, the at least one blade having a cutting face, a trailing face and a top face extending between the cutting face and trailing face, a plurality of cutting elements attached to the at least one blade along the cutting face, a working surface of each of the plurality of cutting elements having a cutting crest at a peak height and a reduced height extending laterally away from the cutting crest. A first of the plurality of cutting elements closer to the tool axis than a second of the plurality of cutting elements has a greater impact resistance than the second of the plurality of cutting elements.

In yet another aspect, embodiments of the present disclosure relate to a downhole cutting tool that includes a tool body having a tool axis, at least one blade extending from the tool body, the at least one blade having a cutting face, a trailing face and a top face extending between the cutting face and trailing face, a plurality of cutting elements attached to the at least one blade along the cutting face, a working surface of each of the plurality of cutting elements having a cutting crest at a peak height and a reduced height extending laterally away from the cutting crest, a first of the plurality of cutting elements further from the tool axis than a second of the plurality of cutting elements has a greater wear resistance than the second of the plurality of cutting elements.

BRIEF DESCRIPTION OF DRAWINGS

Embodiments of the present disclosure are described with reference to the following figures. Like numbers are used throughout the figures to reference like features and components.

DETAILED DESCRIPTION

In one aspect, embodiments of the present disclosure relate to cutting structure design using non-planar cutting elements. Specifically, embodiments disclosed herein relate to improving the life and performance of a downhole cutting tool by positioning non-planar cutting elements in particular arrangements on the cutting tool. An upper or top surface of the ultrahard layer (opposite the substrate on which the ultrahard layer is disposed), is non-planar. Cutting elements of the present disclosure may be mounted to various types of downhole cutting tools, including but not limited to drill bits, such as drag bits, reamers, and other downhole milling tools.

Figure 1:
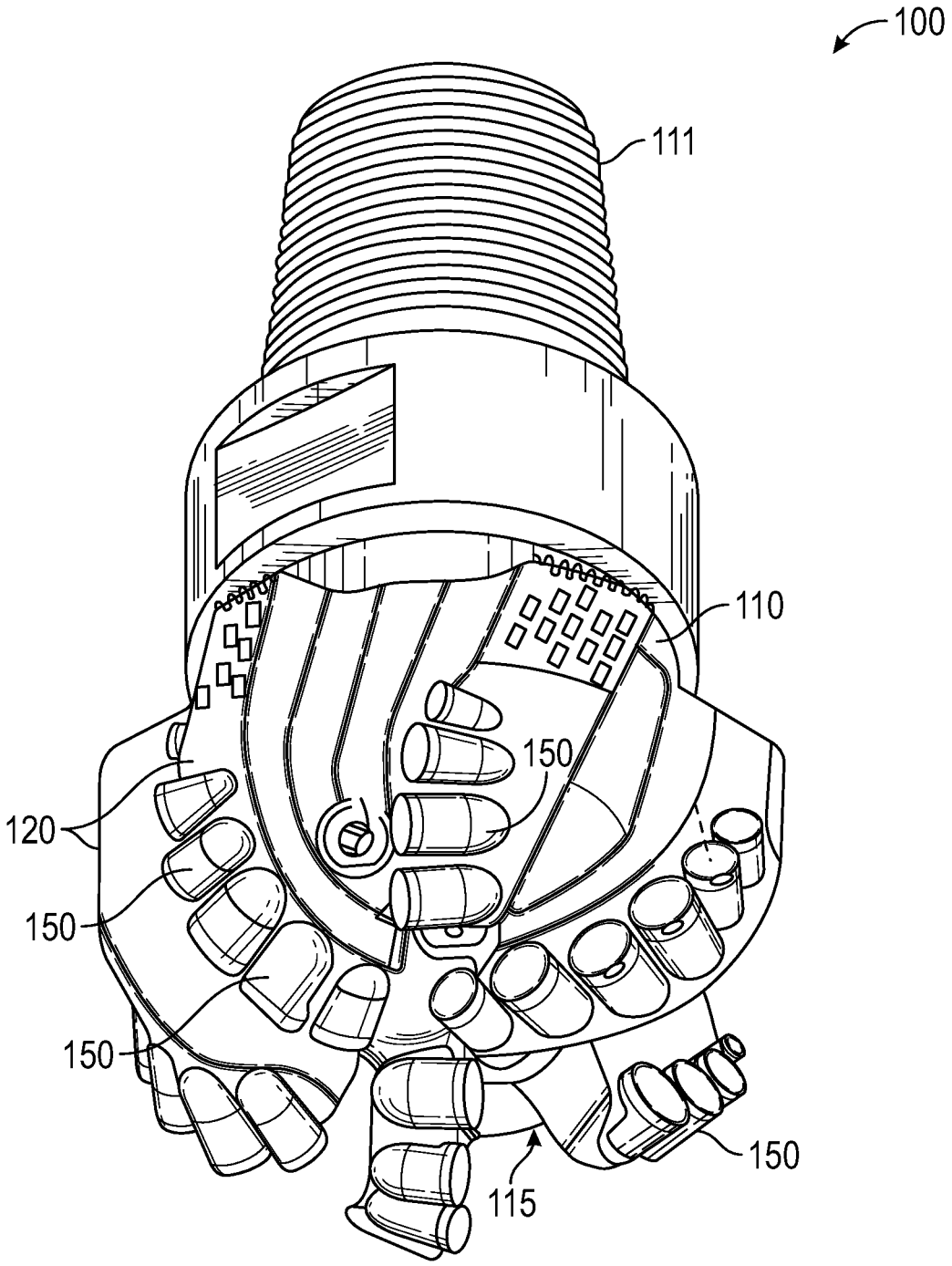
FIG. 1 shows a conventional drag bit.
Figure 2:
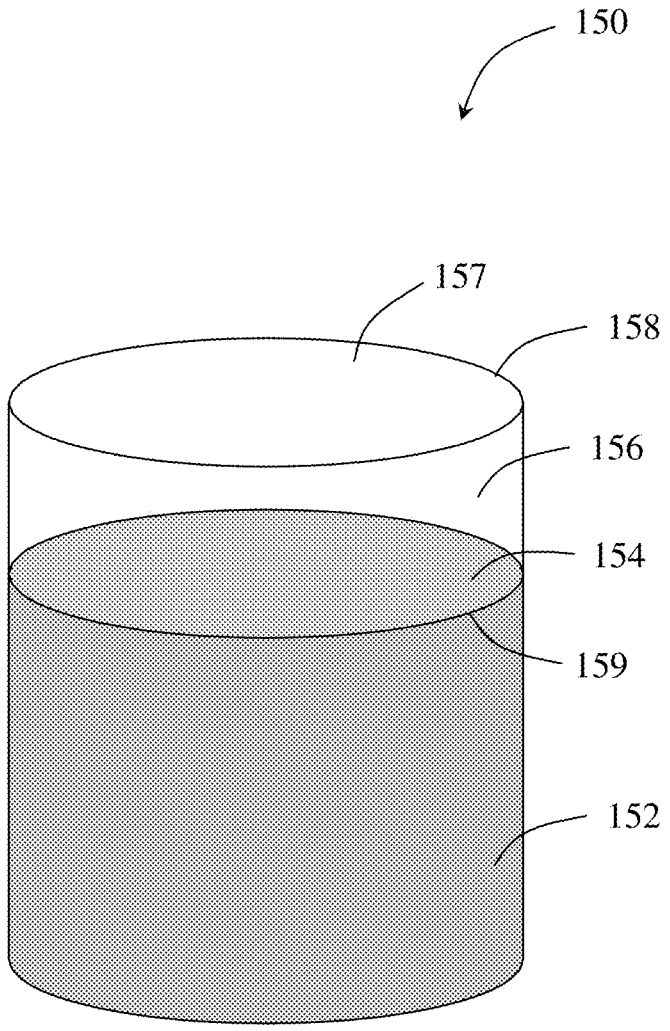
FIG. 2 shows a conventional cutting element.
Figure 3:
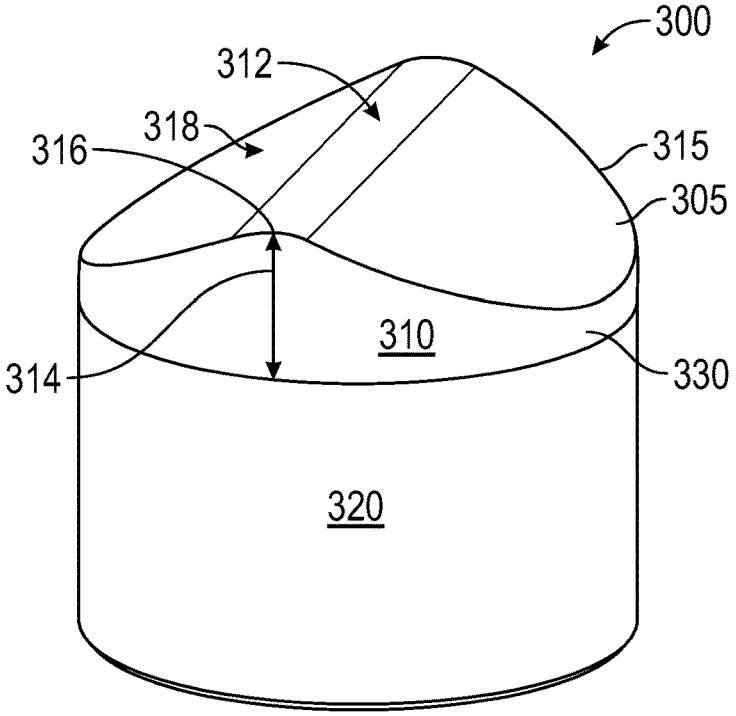
FIGS. 3 and 4 show a cutting element having a non-planar top surface according to embodiments of the present disclosure.
Figure 4:
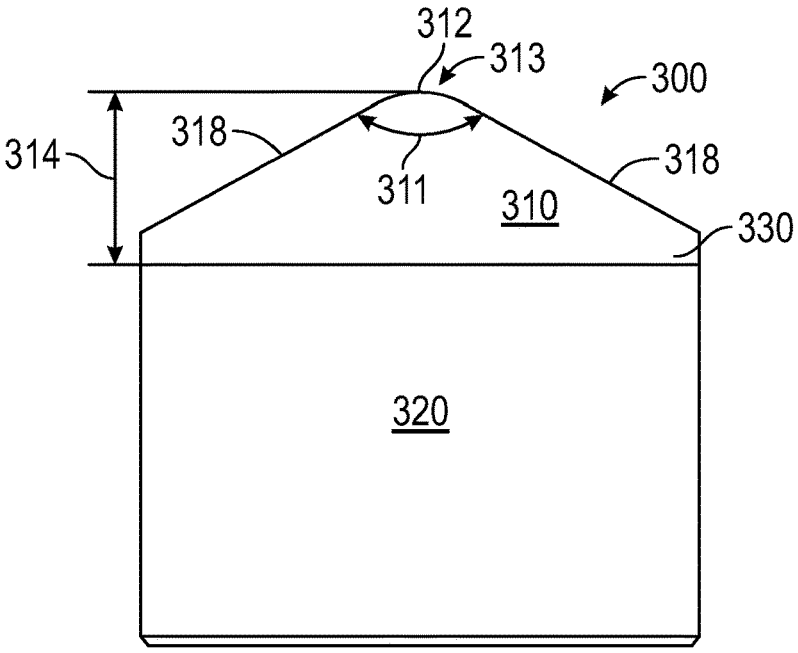
Figure 8:
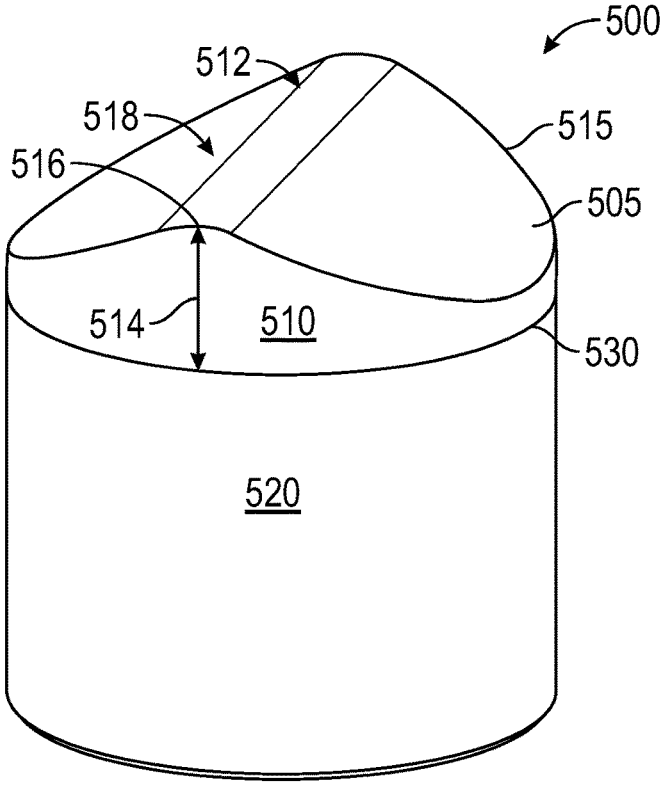
FIGS. 8 and 9 show a cutting element having a non-planar top surface according to embodiments of the present disclosure.

Cutting elements of the present disclosure may optionally have a non-planar interface formed between a substrate and an ultrahard layer, where the top surface of the ultrahard layer is non-planar. For example, according to embodiments of the present disclosure, a cutting element may include a substrate, an upper surface of the substrate including a cutting crest extending along at least a majority of a diameter of the substrate, the upper surface transitioning from the crest into a depressed region, and an ultrahard layer disposed on the substrate upper surface, thereby forming a non-planar interface between the ultrahard layer and the substrate. Cutting elements having a non-planar top or working surface may include, for example, a substantially hyperbolic paraboloid (saddle) shape or a parabolic cylinder shape, where the crest or apex of the cutting element extends across substantially the entire diameter of the cutting element. Further, interface surfaces may also include generally hyperbolic paraboloid shapes, as well as generally parabolic cylinder shapes. For example, as it will be discussed later, cutting elements of the present disclosure may have a working surface that has a cutting crest 312 and 512, as seen in FIGS. 3, 4 and 8, at a peak height and a reduced height extending laterally away from the cutting crest. In some embodiments, the cutting crest may not extend the entire diameter of the substrate.

Placement of Non-Planar Cutting Elements

According to embodiments of the present disclosure, a cutting structure design consideration may include placement of a plurality of non-planar cutting elements on a downhole cutting tool. The cutting tool includes a tool body having a tool axis and at least one blade extending from the tool body. In particular, each blade extending from the tool body includes a cutting face, a trailing face, and a top face that extends between the cutting face and the trailing face. In one or more embodiments, a plurality of cutting elements is attached along the cutting face and top face of at least one blade of the tool. In various embodiments, other configurations may be used. As it will be described later, at least two of the plurality of cutting elements mounted on at least one blade of the tool have different material properties, sizes, orientations, and/or working surface geometries, which may be along a blade profile in one or more embodiments, or between cutting elements mounted along the cutting face compared to the top face in one or more embodiments.

Figure 10:
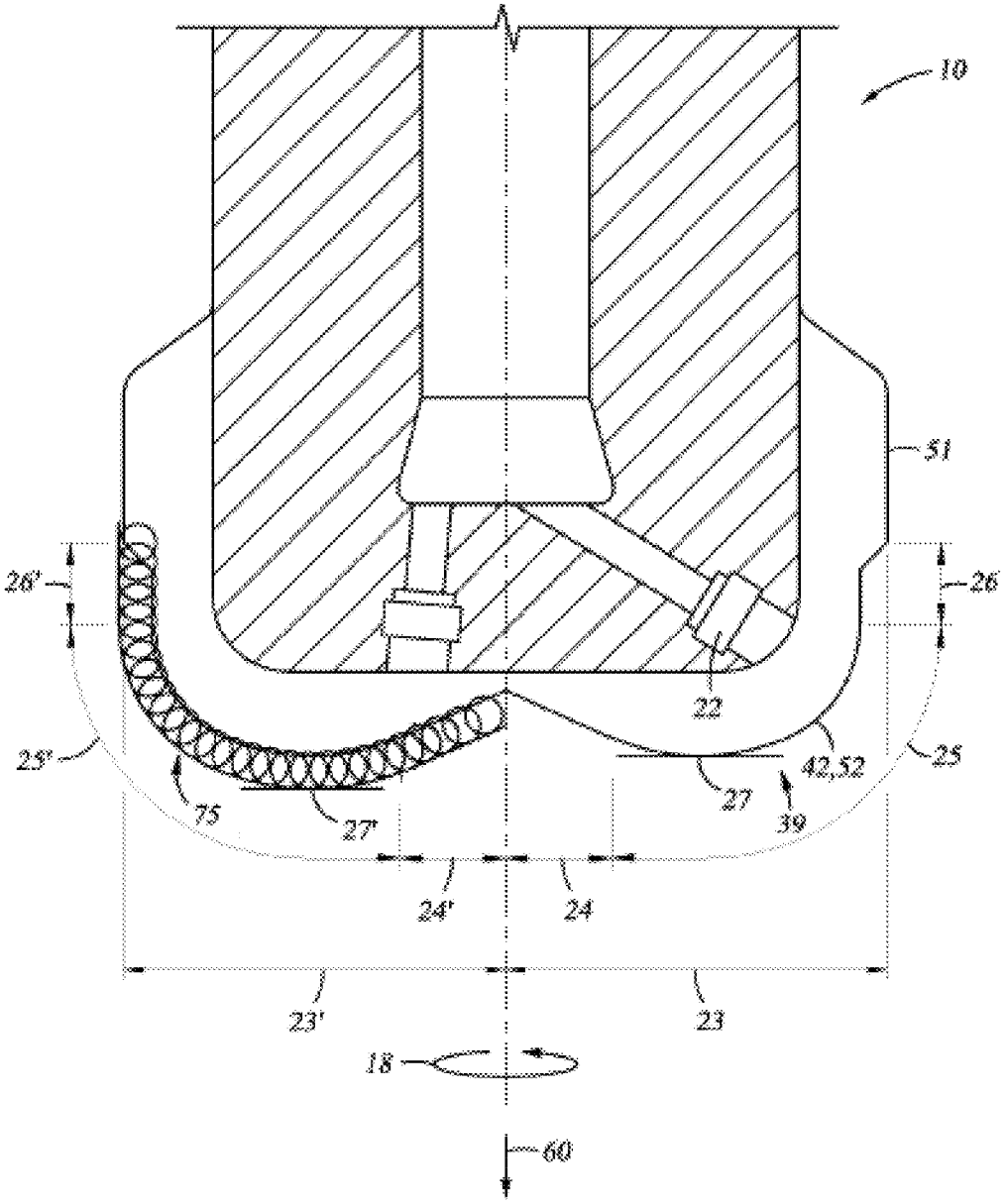
FIG. 10 is a partial cross-sectional view of a bit with the cutting elements of the bit shown rotated into a single profile.
Figure 11:
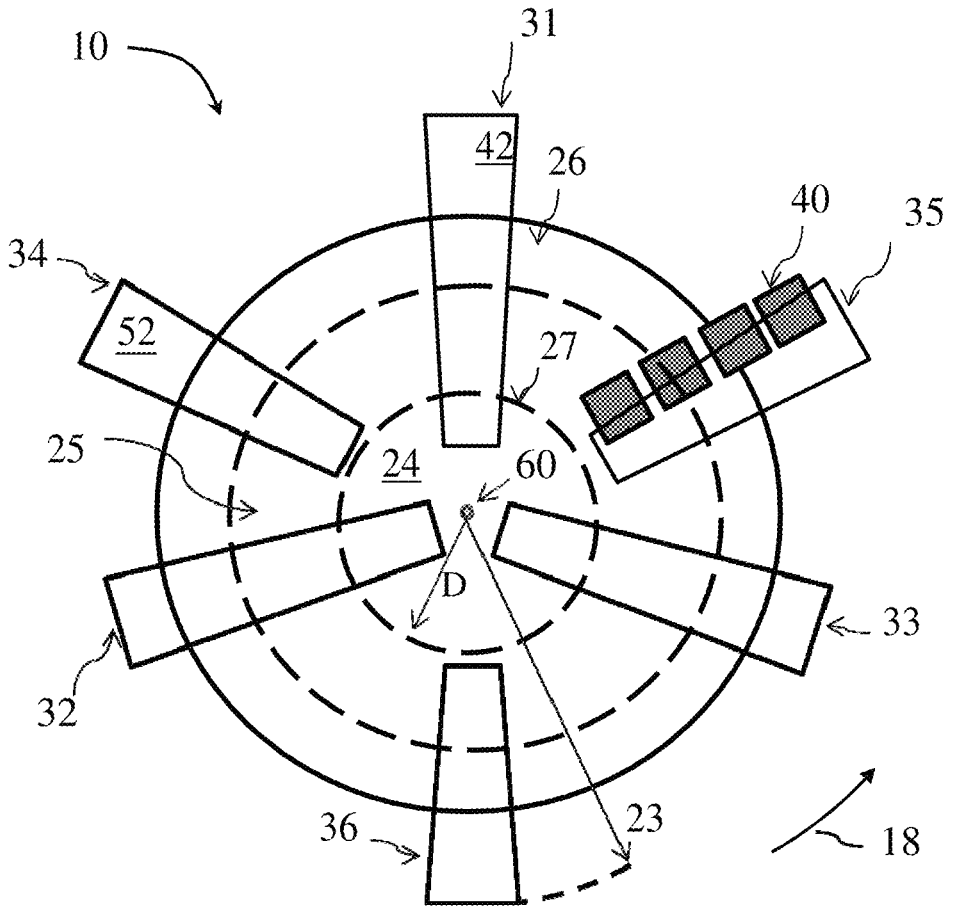
FIG. 11 shows a profile view of a drill bit according to embodiments of the present disclosure.

Referring now to FIG. 10, a profile of bit 10 is shown as it would appear with the blades and the cutting elements rotated into a single rotated profile. Bit 10 includes a central axis 60 about which bit 10 rotates in the cutting direction represented by arrow 18. In rotated profile, the plurality of blades of bit 10 (e.g., primary blades 31-33 and secondary blades 34-36 as shown in FIG. 11) include blade profiles 39. Blade profiles 39 and bit face may be divided into three different regions labeled cone region 24, shoulder region 25, and gage region 26. Cone region 24 is concave in this embodiment and comprises the inner most region of bit 10 (e.g., cone region 24 is the central most region of bit 10). Adjacent cone region 24 is shoulder (or the upturned curve) region 25. In this embodiment, shoulder region 25 is generally convex. The transition between cone region 24 and shoulder region 25, typically referred to as the nose or nose region 27, occurs at the axially outermost portion of composite blade profile 39 where a tangent line to the blade profile 39 has a slope of zero. Moving radially outward, adjacent shoulder region 25 is gage region 26, which extends substantially parallel to bit axis 60 at the radially outer periphery of composite blade profile 39. As shown in composite blade profile 39, gage pads 51 define the outer radius 23 of bit 10. In this embodiment, outer radius 23 extends to and therefore defines the full gage diameter of bit 10. As used herein, the term "full gage diameter" refers to the outer diameter of the bit defined by the radially outermost reaches of the cutter elements and surfaces of the bit.

Referring still to FIG. 10, cone region 24 is defined by a radial distance along the x-axis measured from central axis 60. It is to be understood that the x-axis is perpendicular to central axis 60 and extends radially outward from central axis 60. Cone region 24 may be defined by a percentage of outer radius 23 of bit 10. In some embodiments, cone region 24 extends from central axis 60 to no more than 50% of outer radius 23. In some embodiments, cone region 24 extends from central axis 60 to no more than 30% of outer radius 23. Cone region 24 may likewise be defined by the location of one or more secondary blades (e.g., secondary blades 34-36 as shown in FIG. 11). For example, cone region 24 extends from central axis 60 to a distance at which a secondary blade begins (e.g., distance "D" as illustrated in FIG. 11). In other words, the outer boundary of cone region 24 may coincide with the distance "D" at which one or more secondary blades begin. The actual radius of cone region 24, measured from central axis 60, may vary from bit to bit depending on a variety of factors including without limitation, bit geometry, bit type, location of one or more secondary blades (e.g., secondary blades 34-36), or combinations thereof. For instance, in some cases bit 10 may have a relatively flat parabolic profile resulting in a cone region 24 that is relatively large (e.g., 50% of outer radius 23). However, in other cases, bit 10 may have a relatively long parabolic profile resulting in a relatively smaller cone region 24 (e.g., 30% of outer radius 23).

Referring now to FIG. 11, a schematic top view of bit 10 is illustrated. Moving radially outward from bit axis 60, the bit face includes cone region 24, shoulder region 25, and gage region 26 as previously described. Nose region 27 generally represents the transition between cone region 24 and shoulder region 25. Specifically, cone region 24 extends radially from bit axis 60 to a cone radius, shoulder region 25 extends radially from cone radius to shoulder radius, and gage region 26 extends radially from shoulder radius to bit outer radius 23. Primary blades 31-33 extend radially along bit face from within cone region 24 proximal bit axis 60 toward gage region 26 and outer radius 23. Secondary blades 34-36 extend radially along bit face from proximal nose region 27 toward gage region 26 and outer radius 23. In this embodiment, each secondary blade 34-36 begins at a distance "D" that substantially coincides with the outer radius of cone region 24 (e.g., the intersection of cone region 24 and shoulder region 25). Thus, secondary blades 34-36 do not extend into cone region 24. In other embodiments, the secondary blades (e.g., secondary blades 34-36) may extend to and/or slightly into the cone region (e.g., cone region 24). In this embodiment, each primary blade 31-33 and each secondary blade 34-36 extends substantially to gage region 26 and outer radius 23. However, in other embodiments, one or more primary and/or secondary blades may not extend completely to the gage region or outer radius of the bit.

Referring still to FIG. 11, each primary blade 31-33 and each secondary blade 34-36 generally tapers (e.g., becomes thinner) in top view as it extends radially inwards towards central axis 60. Consequently, primary blades 31-33 are relatively thin proximal axis 60 where space is generally limited circumferentially, and widen towards gage region 26. Although primary blades 31-33 and secondary blades 34-36 extend linearly in the radial direction in top view, in other embodiments, one or more of the primary blades, one or more secondary blades, or combinations thereof may be arcuate or curve along their length in top view.

Primary blades 31-33 and secondary blades 34-36 provide cutting-supporting surfaces 42 and 52, respectively, for mounting a plurality of cutting elements 40. The number of cutting elements on each primary blade (e.g., primary blades 31-33) and each secondary blade (e.g., secondary blades 34-36) may vary or may be equal. The plurality of the cutting elements may be placed along the blade on a cone region, a nose region, a shoulder region and/or a gage region of at least one blade of the tool.

As mentioned above, in one or more embodiments, the cutting elements on a given blade may have differing material properties, sizes, orientations, and/or working surface geometries. In one or more embodiments, the difference may be between cutting elements in different regions of the blade profile, such as between cutting elements in the cone, nose, shoulder, and gage regions of the blade.

Figure 12:
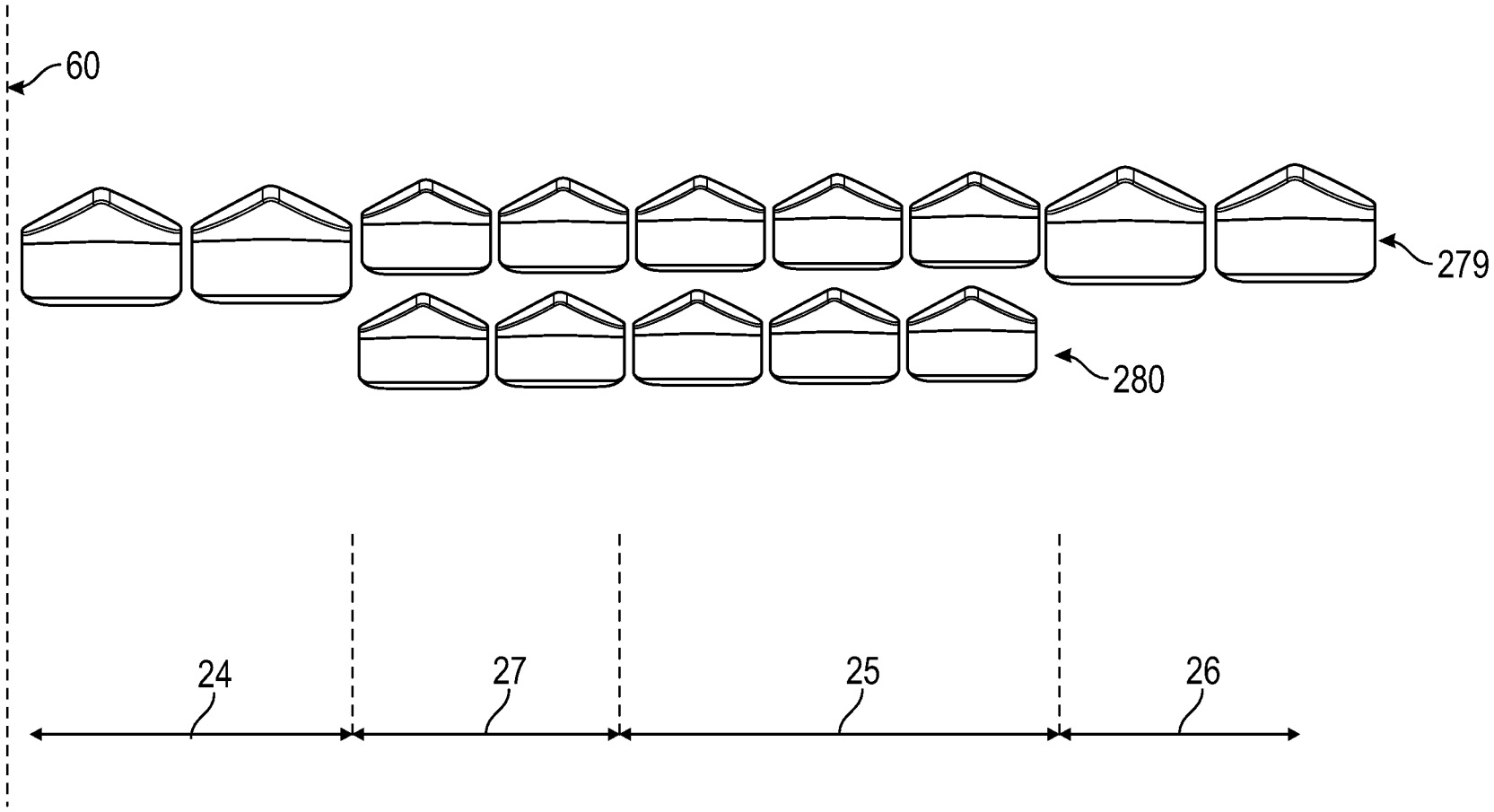
FIG. 12 shows a cutting profile according to embodiments of the present disclosure.

Referring now to FIG. 12, a cutting element layout for an example blade (now shown) is provided. The cutting element layout includes a plurality of cutting elements 279 forming the primary row of cutting elements, and a plurality of cutting elements 280 forming the secondary or back-up row of cutting elements. Additional discussion concerning the back-up row of cutting elements 280 is provided later. The cutting elements 279 forming the primary row extend, in this embodiment, through a cone region 24, nose region 27, shoulder region 25, and gage region 26. As shown, the cutting elements 279 forming the primary row may not have the same size.

For example, at least one of the plurality of cutting elements 279 placed on the cone 24 region of the blade may be larger in size than at least one of the plurality of cutting elements 279 placed on the nose 27 and/or shoulder 25 regions of the blade. Similarly, as shown in FIG. 12, at least one of the plurality of cutting elements placed on the gage region 26 of the blade may be larger than at least one of the plurality of cutting elements placed on the nose 27 and/or shoulder 25 regions of the blade. In this embodiment, the cutting elements 279 placed in the cone 24 and gage 26 regions may have the same size and the cutting elements 279 placed on the nose and/or shoulder of the blade may have the same size. However, different permutations of cutting element sizes may be used (for example, cone and/or gage cutting elements may be smaller than cutting elements in other regions), and that cutting elements within a given region of the blade profile may have different sizes (such as cutting elements within the nose region may also have two or more different sizes and cutting elements within the shoulder may also have two or more different sizes). Further, the differences in size along the blade profile may be between cutting elements on any row. Thus, the placement of cutting elements with different sizes within a given region of the blade profile may reduce or minimize harmful loads and stresses on the cutting elements during drilling. For example, if high loads are expected in a given region of the profile, smaller cutting elements can be used, while larger, more efficient cutting elements can be used in other regions of the profile.

As noted above, cutting elements along the blade profile may have different orientations relative to one another. Such orientations may refer, for example, to back rake, side rake, as well as rotational orientation within a cutter pocket. Further, because the cutting elements of the present disclosure are non-planar cutting elements (and thus do not have a planar cutting face which is conventionally used to define rake angles), the conventional definitions for rake angle do not apply. The orientational definitions may instead be described based, in part, on a particular feature of the non-planar working surface. While greater description of the cutting element geometry may be found below, as noted above, the top or working surface of the ultrahard layer has at least one cutting crest that extends along a diameter from a cutting edge portion radially inward (such as from one edge to another). The cutting crest may, for example, be used to define the orientation of a cutting element on a blade.

Figure 13:
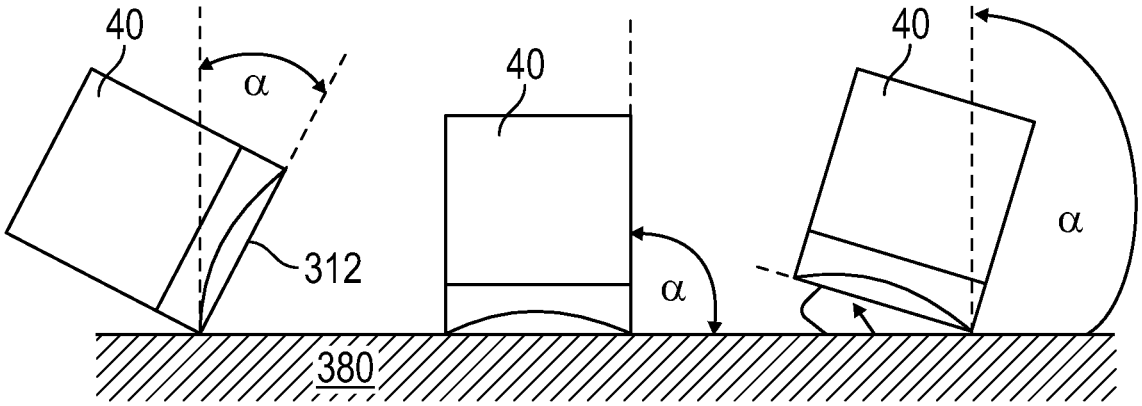
FIGS. 13 and 14 show rotation of cutting elements according to embodiments of the present disclosure.

For example, while back rake is conventionally defined as the angle between the cutting face and a line normal to the formation being cut, for the cutting elements of the present disclosure, the effective back rake may be defined as the angle $\alpha$ formed between a line extending through the radial ends of the cutting crest 312 and a line normal to the formation 380 being cut (or substantially parallel to the tool axis), as shown in FIG. 13. In one or more embodiments, the back rake angle $\alpha$ may range from greater than 0 degrees to 45 degrees (or at least 5, 10, 15, 20, 25, 30, 35, or 40 degrees in various other embodiments). Such back rake angles are negative in the context of the conventional PDC cutters because the angle extends clockwise from the normal line (in contrast to a positive back rake angle where the angle extends in a counter clockwise orientation relative to the normal line). That is, a zero back rake angle for a conventional PDC cutter (and for the cutters of the present disclosure) is formed by the cutting face (or the line extending through the radial ends of the cutting crest) and a line that is parallel to or collinear with the line normal to the formation. A negative angle is formed when the cutting element is tilted so that the cutting face (or cutting crest) angles in a clockwise direction relative to the normal line and a positive angle is formed when the cutting element is tilted so that a cutting face (or cutting crest) angles in a counter clockwise orientation relative to the normal line. However, as shown in FIG. 13, cutting elements 40 may be oriented substantially perpendicular to the blade top. While this orientation is atypical for conventional PDC cutters, a perpendicular or 90° angle is formed by tilting the cutting element in a clockwise rotation by 90° relative to the normal line. Because the orientation is still in the clockwise direction, this backrake angle is also considered to be negative. However, in one or more embodiments, the cutting element 40 may also be oriented at a back rake angle $\alpha$ (formed between a line parallel to the tool axis and a line extending through the radial ends of the cutting crest) ranging from greater than 65 degrees to 115 degrees (or at least 65, 75, 80, 85, 90, 95, 100, 105, 110 degrees in various other embodiments). While embodiments may generally use negative back rake angles, the cutting crest could be orientated a non-perpendicular angle with respect to the central axis of the cutting element, in which case a positive back rake (when an angle between the line extending through the radial ends of the cutting crest and a line normal to the formation extends in a counter clockwise direction) could be used. When selecting different back rake angles for cutting elements placed in various regions of the blade profile, the selection may depend, for example, on where aggressive or passive cutting action is desired.

Figure 16:
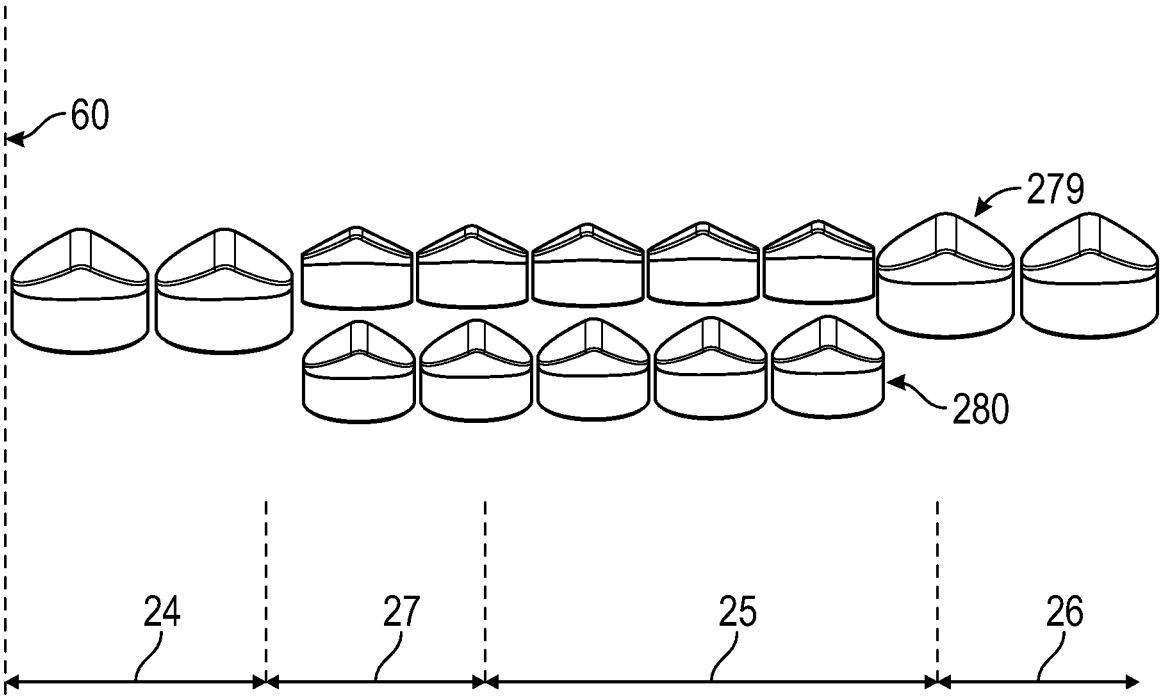

Thus, in some embodiments, the cutting elements of the present disclosure may be placed on the blade at various back rake angles, such as a positive, a neutral or a negative back rake angle. However, all cutting elements may be placed on a blade at a negative back rake angle, and, for example, at least two cutting elements have differing negative back rake angles. For example, such difference in back rake angle may be between at least two cutting elements along a blade profile, such as between cutting elements in different regions of the blade profile. As seen in FIG. 16, a plurality of cutting elements 279 form a first row and extend through a cone 24, nose 27, shoulder 25, and gage 26. At least one of the plurality of cutting elements 279 placed on the nose 27 and/or the shoulder 25 may have smaller back rake angles than at least one of the plurality of cutting elements placed on the cone 24 and/or gage 26 regions. Such a configuration may provide impact protection of the cutting tool. However, other configurations are possible, depending on the applications of the cutting tool. Further, in addition to differing back rake angles, the cutting elements 279 placed in the nose 27 and/or shoulder 25 may be smaller than those in the cone 24 and/or gage 26. In this embodiment, the cutting elements 279 placed in the cone 24 and gage 26 regions may have the same size and the cutting elements 279 placed on the nose and/or shoulder of the blade have the same size. However, different permutations of cutting element back rake angles may be used (for example, cone and/or gage cutting elements may have smaller back rake angles than cutting elements in other regions), and that cutting elements within a given region of the blade profile may have different back rake angles (such as cutting elements within the nose region may also have two or more different back rake angles and cutting elements within the shoulder may also have two or more different back rake angles). Further, the differences in back rake angles along the blade profile may be between cutting elements on any row. Configurations with variable back rake angles and/or sizes of cutting elements placed in different regions of the blade profile may provide for increased aggressiveness of the cutting tool and/or increased longevity of the cutting tool.

Figure 14:
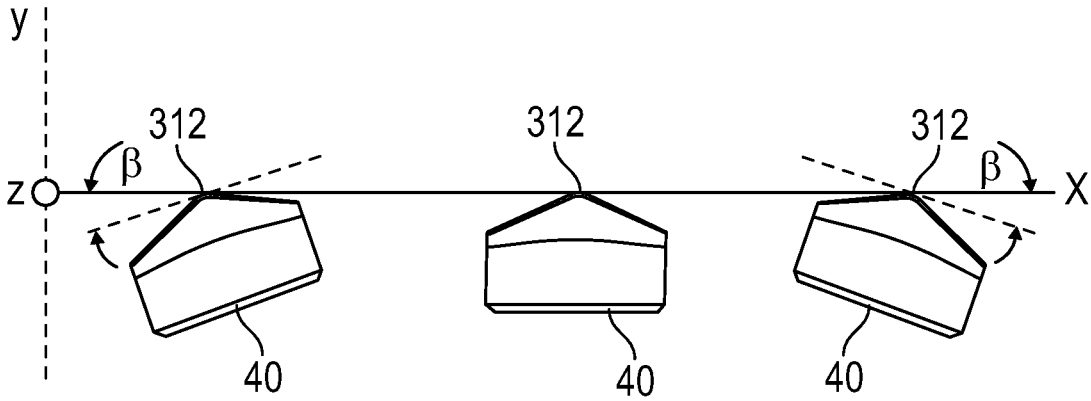

In addition to different back rake angles, cutting elements 40 may also have different side rake angles along a blade profile. Side rake may be defined as the angle $\beta$ formed between a radial plane that is tangent to the peak of the cutting crest 312 and the radial plane of the tool (x-z plane). When viewed along the z-axis, shown in FIG. 14, a negative side rake $\beta$ results from counterclockwise rotation of the cutting element, and a positive side rake $\beta$, from clockwise rotation. In one or more embodiments, at least two cutting elements along a blade profile may have opposite side rake angle directions (positive versus negative) or a positive or neutral side rake angle on one cutting element and a neutral side rake angle on another. In other embodiments, the angle itself may be varied. The angles may range from −30 to 30 degrees, −20 to 20 degrees, or −10 to 10 degrees.

Figure 15:
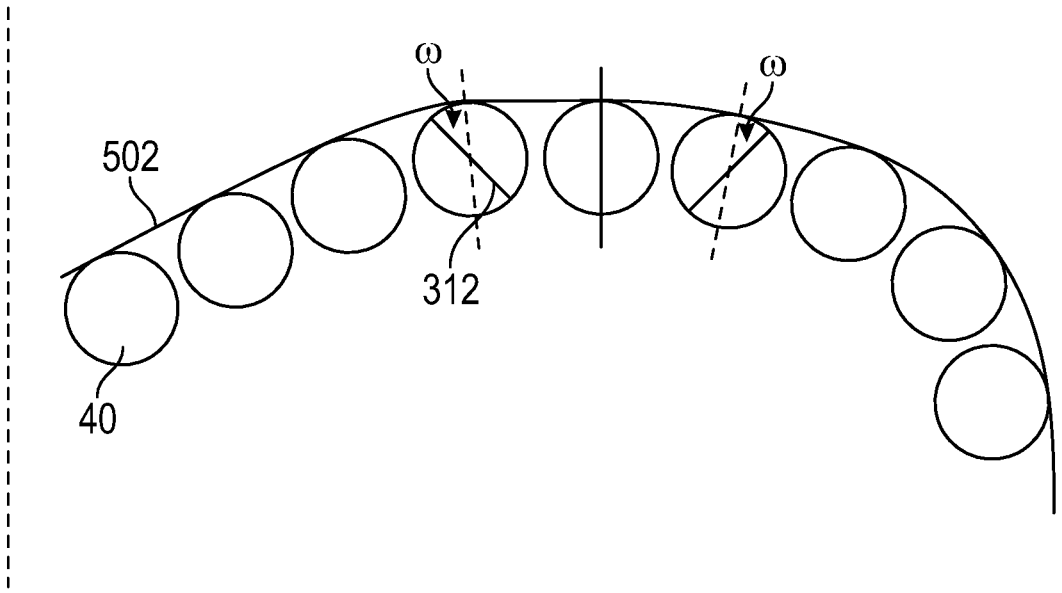
FIGS. 15, 16, and 17 show a cutting profile according to embodiments of the present disclosure.

In addition to the back rake and side rake angles, the aggressiveness of cutting tools may be tailored by varying the rotational orientation of a cutting element within a cutter pocket (defined relative to a cutting profile curve formed from the cutting elements on a given row) along a blade profile. Specifically, as shown in FIG. 15, a cutting profile curve 502 may be the curve formed by extending tangent to each of the cutting elements 40 on a given row. The rotational orientation w of a cutting element may be defined as the angle formed between a line normal to the cutting profile curve 502 and the line extending through the radial ends of the cutting crest 312. A clockwise rotation (shown on the cutting element on the right) may be a positive rotational orientation and a counter clockwise rotation (shown on the cutting element on the left) may be a negative rotational orientation. In one or more embodiments, the rotational orientation may range from 0 to 90 degrees or up to 45, 40, 35, 30, 25, or 20 degrees in various embodiments. Further, at least two rotational orientations may be used between at least two cutting elements having differential positions along the blade profile. For example, such different rotational orientations may be between cutting elements within different regions or portions of the blade profile or the different orientations may be within a single region of the blade profile (such as cutting elements within the nose region may also have two or more different angles and cutting elements within the shoulder may also have two or more different angles).

Figure 17:
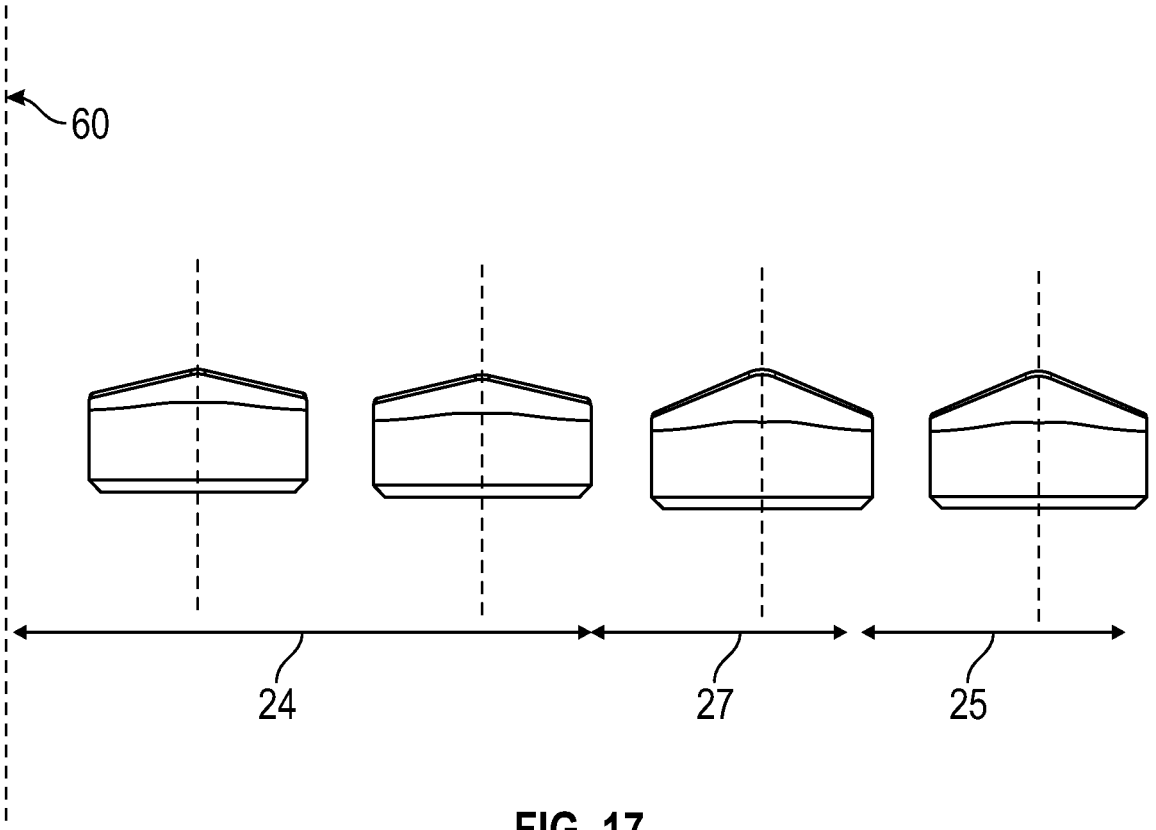
Figure 18:
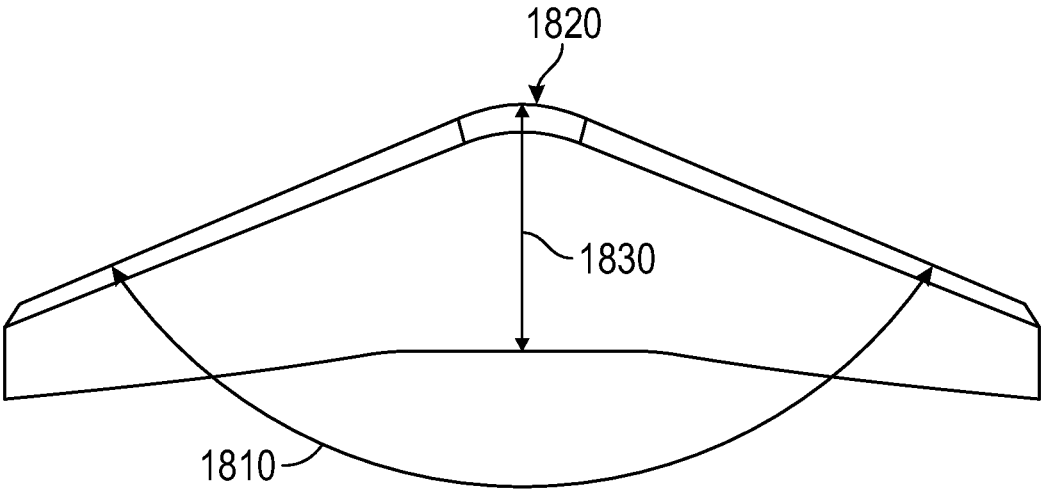
FIG. 18 shows a geometry of a cutting element according to embodiments of the present disclosure.

In addition to the back rake and side rake angle affecting the aggressiveness of the non planar cutting element formation interaction, the cutting end geometry, specifically, the included angle of the working surface formed by the non-planar diamond table of the cutting elements, the radius of curvature at the crest, as well as the shape of the ridge (e.g., planar or radiused) may also affect the aggressiveness of which a non planar cutting element interacts with the formation. As shown in FIG. 4, the cutting crest 312 of a non-planar cutting element of the present disclosure has a convex cross-sectional shape (viewed along a plane perpendicular to cutting crest length across the diameter of the ultrahard layer), where the uppermost point of the crest has a radius of curvature 313 that transitions to opposite side surfaces at an angle 311 called the included angle of the working surface. According to some of the present embodiments, the included angle of the working surface of at least one of the plurality of cutting elements mounted along at least one blade may range from about 100° degrees to less than about 180° or to about 175° in some embodiments, e.g., from 100° to 175°. Further, in one or more embodiments, at least two cutting elements along a blade profile may have a different included angle from one another. For example, the included angle of a first cutting element may be equal or larger than the included angle of a second cutting element. In some embodiments, the included angle of the working surface of at least one of the plurality of cutting elements placed on the cone region 24 may be larger than an included angle of the working surface of at least one of the plurality of cutting elements placed on the nose 27 and/or shoulder 25 regions of the blade. For example, in one or more embodiments, cutting elements in the cone region may have included angles between 130 (or 150) and 175 degrees, whereas cutting elements radially outside the cone region (in the nose, shoulder, and/or gage) may have included angles of less than 130 degrees. In some embodiments, there may be a continuous decrease in the included angle moving radially outward, while other embodiments may have clusters of cutting elements at a particle angle. By placing sharper cutting elements (i.e., having a smaller included angle) in the areas of the bit experiencing the greatest wear, for example the shoulder region 27 of the bit, the wear rate of the bit may be improved. Referring now to FIG. 17, FIG. 17 shows a cutting profile according to one embodiment. As seen in FIG. 17, cutting elements placed on the cone region 24 may have included angles bigger than cutting elements placed on the nose region 27 and shoulder region 25. Referring now to FIG. 18, FIG. 18 shows a cross-sectional view of a cutting element of the present disclosure indicating the included angle 1810 of the working surface, the radius of curvature 1820 at the crest, as well as the diamond table thickness 1830. Cutting elements placed along the blade may have different radii of curvature at the crest. For example, the radius of curvature at the crest may range from 0.02 in. (0.51 mm) to 0.300 in. (7.62 mm), or in another embodiment, from 0.06 in. (1.52 mm) to 0.18 in. (4.57 mm). In one embodiment, the radius of curvature at the crest of at least a cutting element placed on the cone region of the tool body may be smaller than a radius of curvature at the crest of the another cutting element placed on the nose and/or the shoulder regions of the tool body. Cutting elements with equal or different full radius top may be used.

The cutting elements disposed on the several blades of a fixed cutter bit are typically formed of extremely hard materials and include a layer of polycrystalline diamond material. In the typical fixed cutter bit, each cutting element or assembly comprises an elongated and generally cylindrical support member which is received and secured in a mating pocket formed in the surface of one of the several blades. A cutting element typically has a hard cutting layer of polycrystalline diamond or other superabrasive material such as cubic boron nitride, thermally stable diamond, polycrystalline cubic boron nitride, or ultrahard tungsten carbide (meaning a tungsten carbide material having a wear-resistance that is greater than the wear-resistance of the material forming the substrate), as well as mixtures or combinations of these materials. The cutting layer is exposed on one end of its support member, which is typically formed of tungsten carbide, often forming a polycrystalline diamond compact (PDC). For convenience, as used herein, reference to "PDC bit" or "PDC cutting element" refers to a fixed cutter bit or cutting element employing a hard cutting layer of polycrystalline diamond or other superabrasive material such as cubic boron nitride, thermally stable diamond, polycrystalline cubic boron nitride, or ultrahard tungsten carbide.

According to the present disclosure, the plurality of the cutting elements have a diamond table that may be formed on the substrate, or may be separately formed and subsequently attached together. Depending on the location of the cutting element on the tool and the properties of the cutting element (wear versus impact resistance), different grades of polycrystalline diamond may be used. According to various embodiments, the diamond table may be formed from materials having different particle sizes but same binder content, same particle sizes but different binder content, or different particle sizes and different binder content. For example, average diamond grain sizes may be within the range of about 1 micron to about 40 microns, where the lower limit can be any of 1 micron, 2 microns, or 3 microns and the upper limit can be any of 25 microns, 30 microns or 40 microns, where any lower limit can be used with any upper limit. In such embodiment, the binder content may range from about 1% to about 15% by weight, where the lower limit can be any of 1%, 2%, or 5% and the upper limit can be any of 10%, 12% or 15%, where any lower limit can be used with any upper limit. Multi-layers of diamond may be used.

When greater wear resistance is desired, a smaller particle size may be used (e.g., an average grain size of 1-2 microns as compared to 30-40 microns for another location), and when greater impact resistance is desired, a greater binder content (e.g., 10-15% by weight based on the total weight of at least a portion of the diamond layer as compared to a content of 1-2% by weight based on the total weight of at least a portion of the diamond layer in another location) may be used or a larger grain size (such as 30-40 microns as compared to a smaller size) may be used. According to various embodiments, one of the plurality of cutting elements closer to the tool axis than a second of the plurality of cutting elements has a greater impact resistance (e.g., greater binder content) than the second of the plurality of cutting elements or vice versa. In one or more embodiments, a first of the plurality of cutting elements further from the tool axis than a second of the plurality of cutting elements has a greater wear resistance (e.g., smaller particle size) than the second of the plurality of cutting elements or vice versa.

While the above embodiments describe use of non-planar cutting elements having differing material properties, sizes, orientations, and/or working surface geometries along a blade profile, the present disclosure is not so limited. Rather, embodiments may also relate to multiple non-planar cutting elements positioned in a leading and trailing relationship on a given blade. For example, according to various embodiments, a first plurality of cutting elements may be attached adjacent one another generally in a first row extending radially along at least one blade of the cutting tool, such as along the cutting face of at least one blade (specifically at the intersection of the cutting face (or front face) and the top face). Further, a second plurality of cutting elements may be attached on the same blade, adjacent one another generally in a second row extending along the top face of the blade, rearward from the first plurality of cutting elements. The first row (along the cutting face) may often be referred to as the leading or primary row of cutting elements, and the second row (along the top face, rearward from the first row) may be referred to as the secondary, back-up, or trailing row of cutting elements.

In one or more embodiments, the second plurality of cutting elements may be placed rearward from and at the same radial position from the tool axis as the cutting elements placed along the cutting face of the blade. The second plurality of cutting elements may be placed rearward from and radially between the first plurality of cutting elements. According to some of the present embodiments, the number of the first and second plurality of cutting elements placed along the blade may vary. According to the present embodiments, at least one cutting element from the first row placed on the cutting face and at least one cutting element from the second row placed on the top face of at least one blade may have different material properties, sizes, orientations, and/or working surface geometries.

Figure 19:
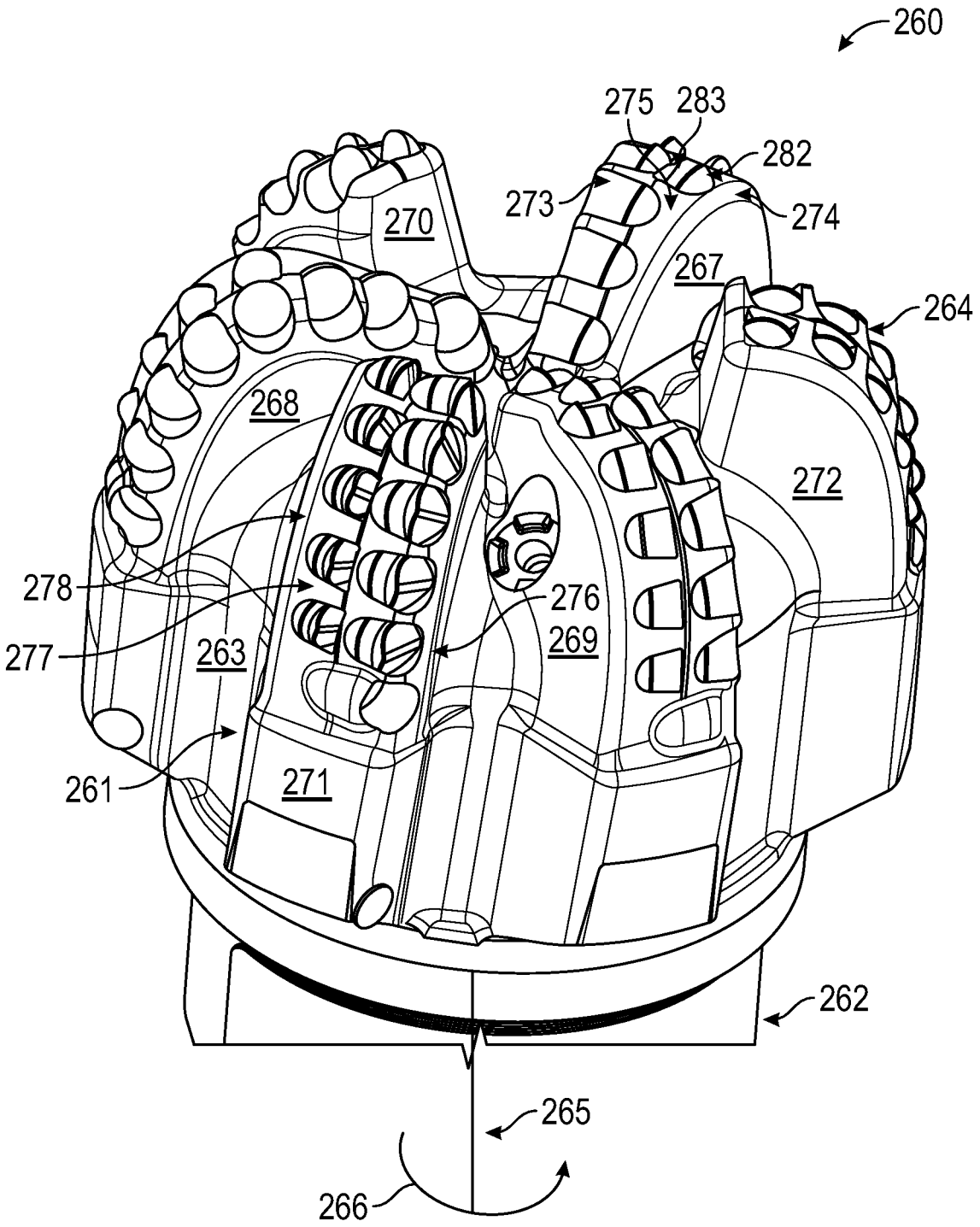
FIGS. 19 and 20 show a perspective view of a drill bit according to embodiments of the present disclosure.
Figure 20:
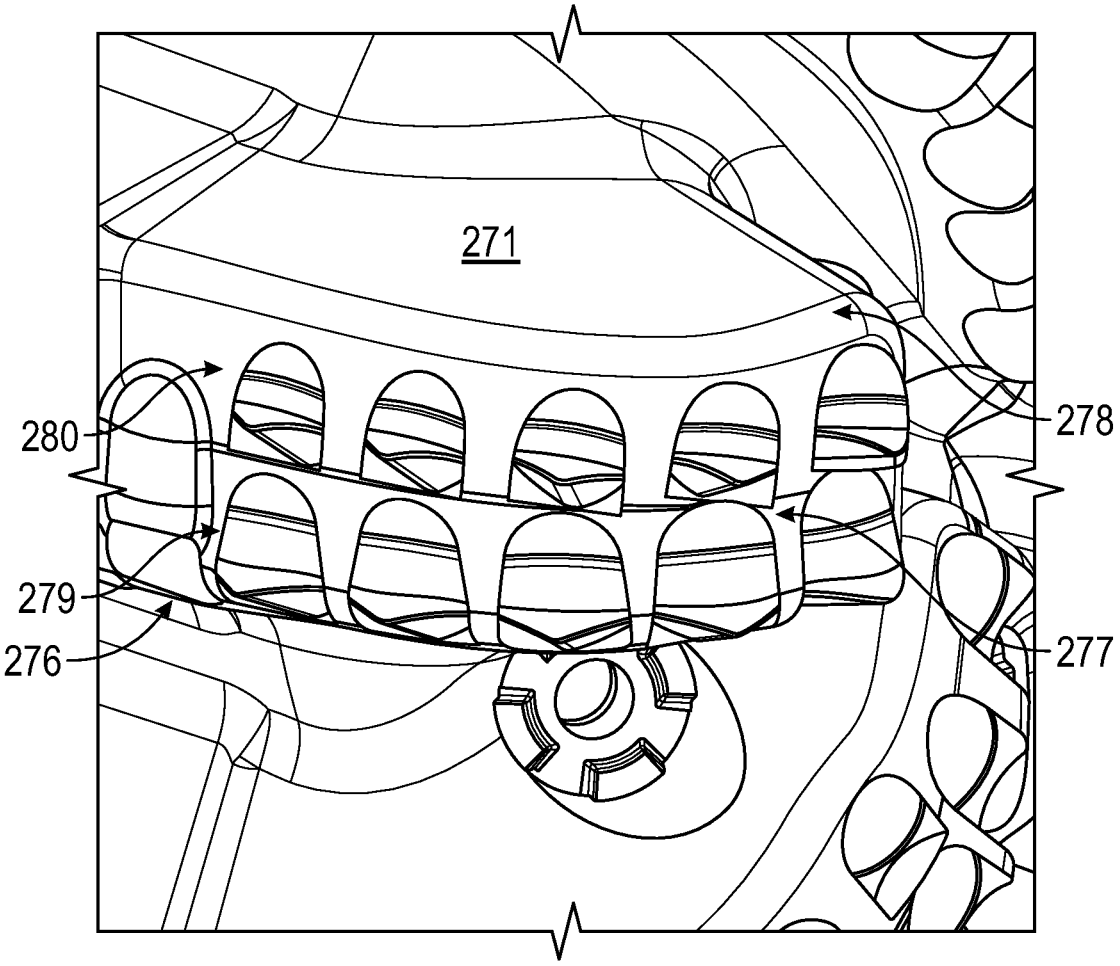

Referring now to FIGS. 19 and 20, FIGS. 19 and 20 show partial views of a bit according to embodiments of the present disclosure. The bit 260 generally includes a bit body 261, a shank 262 and a threaded connection or pin for connecting bit 260 to a drill string, which is employed to rotate the bit in order to drill the borehole. Bit face 263 supports a cutting structure 264 and is formed on the end of the bit 260 that is opposite to pin end. Bit 260 further includes a central axis 265 about which bit 260 rotates in the cutting direction represented by arrow 266. As used herein, the terms "axial" and "axially" generally mean along or parallel to the bit axis (e.g., bit axis 265), while the terms "radial" and "radially" generally mean perpendicular to the bit axis. For instance, an axial distance refers to a distance measured along or parallel to the bit axis, and a radial distance refers to a distance measured perpendicularly from the bit axis. Body 261 may be formed in a conventional manner using powdered metal tungsten carbide particles in a binder material to form a hard metal cast matrix. The body can also be machined from a metal block, such as steel, rather than being formed from a matrix.

The cutting structure 264 is provided on face 263 of bit 260. Cutting structure 264 includes a plurality of blades which extend from bit face 263. In the embodiment illustrated in FIGS. 19 and 20, cutting structure 264 includes three primary blades 267-269 circumferentially spaced-apart about bit axis 265, and three secondary blades 270-272 circumferentially spaced-apart about bit axis 265. In this embodiment, the plurality of blades (e.g., primary blades 267-269 and secondary blades 270-272) are uniformly angularly spaced on bit face 263 about bit axis 265. In particular, each blade 267-272 is generally being spaced about 60° from its adjacent blades 267-272. In other embodiments (not specifically illustrated), the blades may be spaced non-uniformly about the bit face. Moreover, although bit 260 is shown as having three primary blades 267-269 and three secondary blades 270-272, in general, bit 260 may comprise any suitable number of primary and secondary blades.

Still referring to FIGS. 19 and 20, primary blades 267-269 and secondary blades 270-272 are integrally formed as part of, and extend from, bit body 261 and bit face 263. Primary blades 267-269 and secondary blades 270-272 extend radially across bit face 263 and longitudinally along a portion of the periphery of bit 260. Primary blades 267-269 extend radially from substantially proximal central axis 265 toward the periphery of bit 260. Thus, as used herein, the term "primary blade" refers to a blade that begins proximal the bit axis and extends generally radially outward along the bit face to the periphery of the bit. However, secondary blades 270-272 do not extend from substantially proximal central axis 265. Rather, secondary blades 270-272 extend radially from a location that is away from central axis 265 toward the periphery of bit 260. Hence, primary blades 267-269 extend closer to central axis 265 than secondary blades 270-272. Thus, as used herein, the term "secondary blade" refers to a blade that begins at some distance from the bit axis and extends generally radially along the bit face to the periphery of the bit. As shown in FIGS. 19 and 20, each primary blade 267-269 has a cutting face 273 that faces in the direction of bit rotation, a trailing face 274 opposite the cutting face 273, and a top face 275, extending between the cutting face 273 and the trailing face 274. Similarly, each secondary blade 270-272 has a cutting face 276, a trailing face 278, and a top face 277.

According to various embodiments, each primary and/or secondary blade includes a first and a second plurality of cutting elements mounted thereon. For example, FIG. 20 shows the secondary blade 271 of bit 260. A first plurality (or first row) of non-planar cutting elements 279 is placed along the cutting face 276 of blade 271. The bit 260 further includes a second plurality (or second row) of non-planar cutting elements 280 disposed along the top face 277 of the blade 271, rearward from the first plurality 279. In other words, the first plurality 279 of cutting elements may be disposed along the blade 271 at the cutting face 276, while the second plurality 280 of cutting elements is disposed along the top face 277 of the blade 271 in a position that is distal from the cutting face 276. As exemplified in FIG. 20, the second plurality 280 of cutting elements is placed rearward from and at the same radial position from the tool axis 265 as the first plurality 279 of cutting elements.

Still referring to FIG. 20, the relative position of the first plurality of cutting elements 279 and the second plurality of cutting elements 280 along the blade 271 may be described in terms of leading-trailing perspective. Specifically, as seen in FIG. 20, the second plurality of cutting elements 280 is positioned rearward of the first plurality of cutting elements 279, such that one or more cutting elements of the first plurality of cutting elements 279 shares a radial position with one or more cutting elements of the second plurality of cutting elements 280. Cutting elements sharing the same radial position on a blade are positioned at the same radial distance from the central or longitudinal axis 265 of the bit, such that as the bit rotates, the cutting elements cut along the same radial path. A cutting element of the second plurality of cutting elements 280 and a cutting element of the first plurality of cutting elements 279 sharing a same radial position may be referred to as a back-up cutting element and a primary (or leading) cutting element, respectively. In other words, as used herein, the term "back-up cutting element" is used to describe a cutting element that trails any other cutting element on the same blade when the bit is rotated in the cutting direction, and the term "primary (or leading) cutting element" is used to describe a cutting element provided on the leading edge of a blade. Thus, when a bit is rotated about its central axis in the cutting direction, a "primary cutting element" does not trail any other cutting elements on the same blade. Other cutting elements of the second plurality of cutting elements 280 may partially overlap the radial position of cutting elements of the first plurality of cutting elements 279, or may be positioned in a radially adjacent position to cutting elements in the first row (i.e., where a cutting element in the second row is positioned rearward of a cutting element in the first row and do not share a radial position along the bit blade). The placement of cutting elements in two different rows, such as, for example, 279 and 280 (as seen in FIG. 20), may improve the lifetime of the cutting tool, as the cutting elements may be exposed to different loads and stresses.

Figure 21:
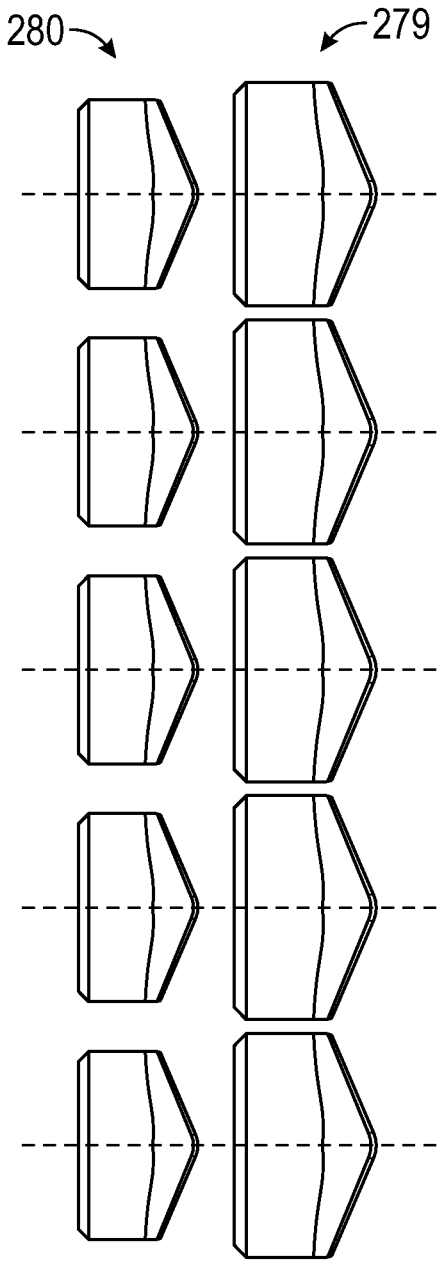
FIGS. 21-26 show cutting profiles according to embodiments of the present disclosure.
Figure 22:
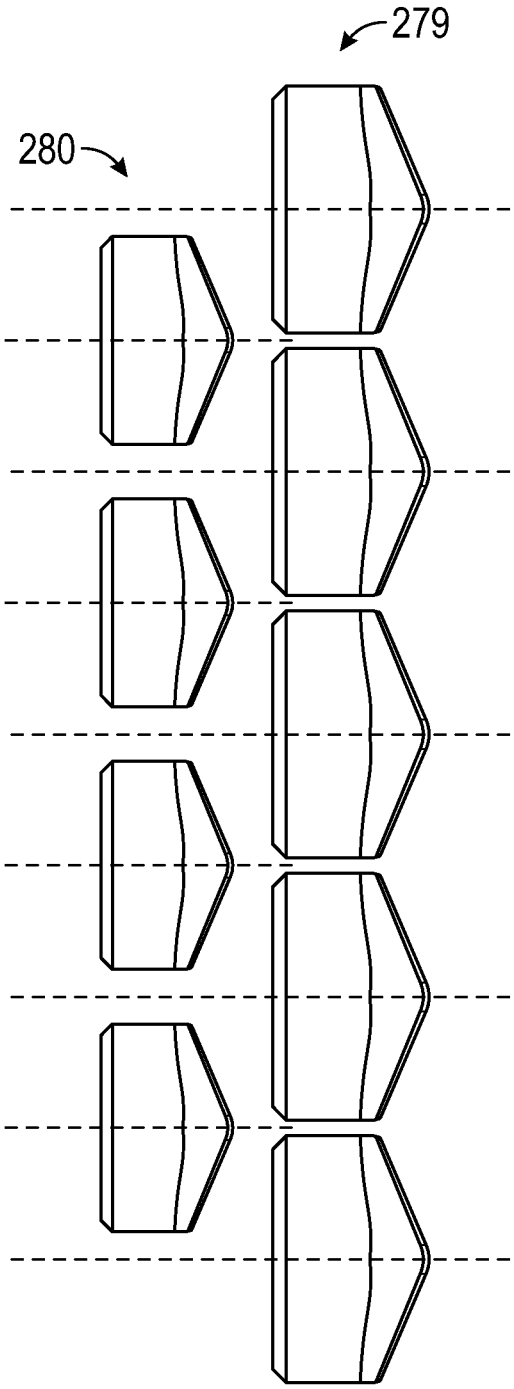

Referring again to FIGS. 19 and 20, leading cutting elements 279 are positioned adjacent one another generally in a first row extending radially along each blade 267-272. Further, back-up cutting elements 280 are positioned adjacent one another generally in a second row extending radially along each blade 267-272. Back-up cutting elements 280 are positioned behind the leading cutting elements 279 provided on the same blade (e.g., secondary blade 271). As seen in FIGS. 19 and 20, when bit 260 rotates about central axis 265 in the cutting direction represented by arrow 266, back-up cutting elements 280 trail the leading cutting elements 279 provided on the same blade 271. This is schematically shown in FIG. 21. However, as noted above, the back-up cutting elements 280 may be non-trailing when they are placed rearward from and radially between the leading cutting elements 279, as shown in FIG. 22. In such an embodiment, greater cutting tip engagement may be expected if the back-up cutting elements are on profile. This configuration may be beneficial to the overall rock breaking efficiency.

As used herein, the terms "leads," "leading," "trails," and "trailing" are used to describe the relative positions of two structures (e.g., two cutting elements) on the same blade relative to the direction of bit rotation. In particular, a first structure that is disposed ahead or in front of a second structure on the same blade relative to the direction of bit rotation "leads" the second structure (i.e., the first structure is in a "leading" position), whereas the second structure that is disposed behind the first structure on the same blade relative to the direction of bit rotation "trails" the first structure (i.e., the second structure is in a "trailing" position).

In general, primary (or leading) cutting elements 279 and back-up cutting elements 280 need not be positioned in rows, but may be mounted in other suitable arrangements provided each cutting element is either in a leading position (e.g., primary cutter element 279) or trailing position (e.g., back-up cutter element 280). Examples of suitable arrangements may include without limitation, rows, arrays or organized patterns, randomly, sinusoidal pattern, or combinations thereof. Further, in other embodiments, additional rows of cutter elements may be provided on a primary blade, secondary blade, or combinations thereof.

Referring again to FIGS. 19 and 20, leading and back-up cutting elements 279 and 280, respectively, may be disposed within the cone, shoulder, nose and/or gage regions of at least one blade of the cutting tool. In various embodiments, primary cutting elements 279 may be placed along the entire length of at least a blade of a tool. In yet another embodiment, the back-up cutting elements 280 may be placed on the same blade, rearward from the primary cutting elements 279, within the nose and shoulder of at least one blade (e.g., blade 271).

The general concept of "off and on profile" will be described using cutting elements 2300 and 2320, as shown in the cross-sectional views of FIGS. 23 and 24. The cutting edge 2310 of cutting element 2300 lies on a primary cutting profile. As used herein, the primary cutting profile refers to the curve or profile passing through the edge of each cutting crest of the cutting elements (such as cutting element 2300) placed on a cutting face (e.g., cutting face 273 as shown in FIG. 19) of a blade (e.g., blade 267 as shown in FIG. 19). A back-up cutting profile refers to the curve or profile passing through the edge of each cutting crest of the cutting elements forming the secondary or back-up row of cutting elements (such as cutting element 282 having an edge 283) placed on a top face (e.g. top face 275 as shown in FIG. 19) of a blade (e.g., blade 267 as shown in FIG. 19).

Figure 23:
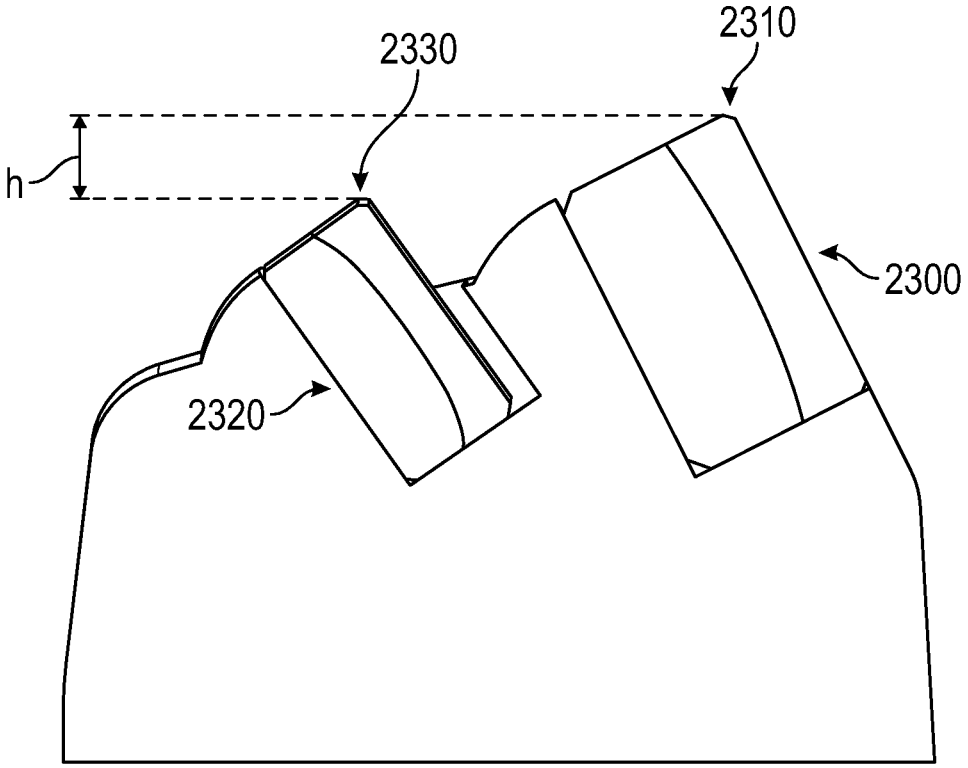
Figure 24:
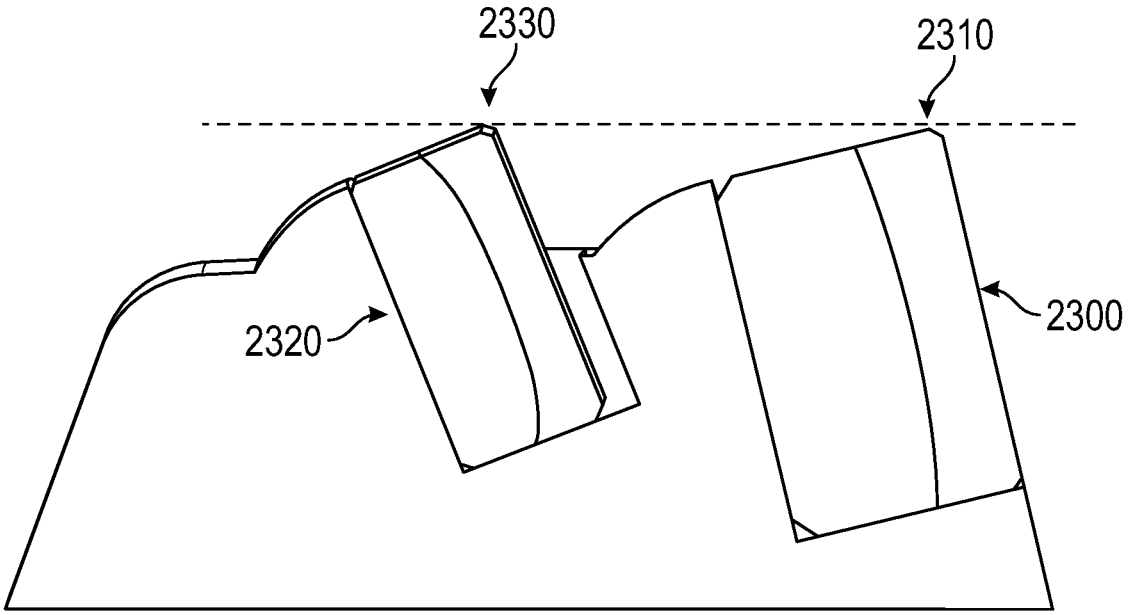

Referring now to FIG. 23, the cutting edge 2330 (and thus back-up profile) of the second cutting element 2320 may not extend to (i.e., is axially separated or offset from) the primary cutting profile defined by the cutting edge 2310 of the cutting element 2300, and thus, may be described as being offset, "off profile" or "under profile" relative to the primary cutting profile. As used herein, the phrase "off profile" refers to a cutting element extending from a cutting face (e.g., cutting face 273 as shown in FIG. 19) of a blade (e.g., blade 267 as shown in FIG. 19) that does not extend to the primary cutting profile in rotated profile view. In such a case, the first plurality of cutting elements may be arranged in such a manner that they are over-exposed to the formation with respect to the second plurality of cutting elements. Similarly, the phrase "on profile" refers to the structure that extends from the cutting face to the primary cutting profile in rotated profile view, when both pluralities of cutting elements engage the formation at the same point, or depth of cut, as shown in FIG. 24.

The degree to which an off-profile cutting element is offset from the outermost cutting profile may be described in terms of a "cutting profile offset distance" or "exposure height," h, equal to the minimum or shortest distance between the structure and the primary cutting profile in rotated profile view, as shown in FIG. 23. The selection of the exposure height difference may be based, for example, on the type of formation to be drilled. Further, the exposure difference may allow for improving the efficiency of drilling in transition between different formation types. If a leading cutting element has a greater exposure height (for drilling through a softer formation), it may dull when a different formation type is hit and the dulling of the cutting element may allow for engagement of the back-up cutting element. In various embodiments, the cutting profile offset distance h ranges from 0.010 in. (0.254 mm) to 0.100 in. (2.54 mm), where the limits can be any of 0.015 in. (0.381 mm), 0.020 in. (0.508 mm), 0.070 in. (1.778 mm), 0.090 in. (2.286 mm), or 0.100 in. (2.54 mm), where any limit can be used in combination with any other limit. Although the cutting profile of cutting element 2320 is off-profile in this embodiment, in other embodiments, one or more of the second cutting elements (e.g. cutting element 2320) may be on-profile, as shown in FIG. 24.

Referring again to FIG. 20, each cutting element of the first plurality 279 of cutting elements and each cutting element of the second plurality of cutting elements 280 may have any suitable size and geometry. According to various embodiments, the plurality of cutting elements placed along the cutting face 276 may have the same size. However, as discussed above, two or more of the first plurality of cutting elements 279 placed along the cutting face (i.e., along a blade profile) may have different sizes. Similarly, cutting elements of the second plurality of cutting elements 280 may have the same or different sizes along the blade profile. Further, at least one of the first plurality of cutting elements 279 and at least one of the second plurality of cutting elements 280 may have different sizes, relative to one another. In one or more embodiments, at least one of the first plurality of cutting elements 279 may be larger (i.e., have a larger diameter) than at least one of the second plurality of cutting elements 280.

As compared to other cutting tools, such as for example conventional cutter elements, the present embodiments may offer the potential for controlled aggressiveness in different regions of the blade, depending on the regions with higher loads and stresses. Thus, depending on the type of formation, the aggressiveness may be tailored by using different sizes and/or geometry of cutter elements in the regions with higher loads and stresses. According to various embodiments, primary and back-up cutting elements may have a different size and/or geometry. For example, according to the present embodiments, at least one primary cutting element and at least one back-up cutting element may have different sizes (e.g., diameters). For example, at least one primary cutting element may have a larger size than at least one back-up cutting element. Such combinations are shown in FIGS. 12, 16, 21, and 22, for example. Specifically, FIGS. 12 and 16 both show primary cutting elements (in the cone and gage regions) being larger than each of the back-up cutting elements (in the nose and shoulder regions). FIGS. 21 and 22 show that the back-up cutting elements 280 may be smaller than the primary cutting elements 279, when they are trailing or non-trailing. Specifically, as seen in FIG. 12, a first plurality of leading cutting elements 279 is placed along at least one blade (primary and/or secondary as shown in FIG. 11) of a cutting tool, in the cone region 24, nose region 27, shoulder region 25, and gage region 26. As seen in FIG. 12, the cutting elements placed on the cone region 24 and on the gage region 26 have the same size. However, these cutting elements are larger in size than the leading cutting elements placed on the nose region 27 and shoulder region 25, improving the aggressiveness of the cutting tool. As exemplified in FIG. 12, a second plurality of back-up cutting elements 280 is placed on the same blade, rearward from and at the same radial position from the tool axis as the leading cutting elements 279. As seen in FIG. 12, the back-up cutting elements 280 placed on the nose and shoulder regions have the same size as the corresponding leading cutting elements 279. Further, the back-up cutting elements 280 are smaller than the leading cutting elements 279 in the cone and gage regions.

Figure 25:
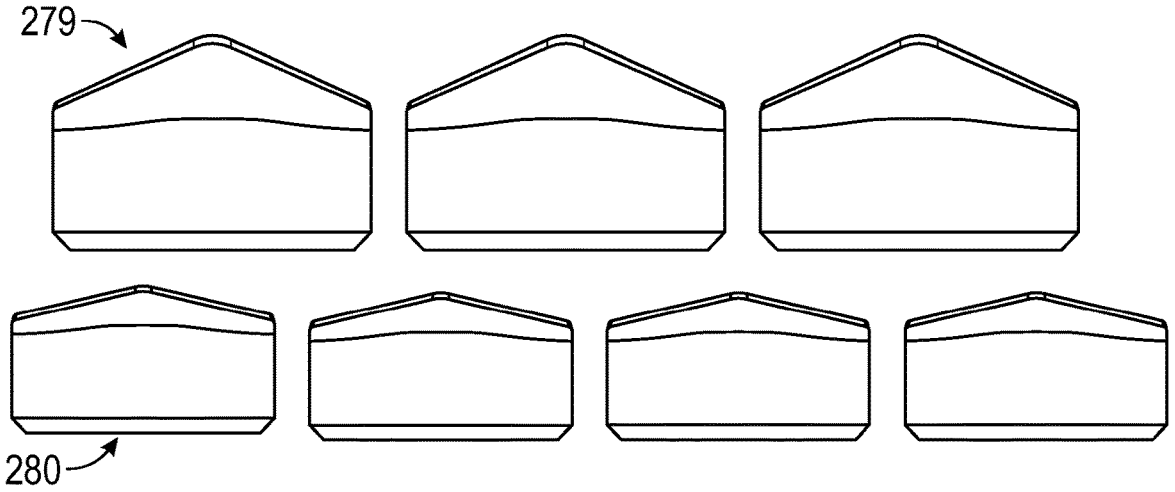

Further, in such embodiments, in order to mitigate an expected lower side impact resistance of smaller non-planar cutting elements, a different included angle of the working surfaces, as well as different top radii of the cutting elements may be used. For example, as shown in FIG. 25, back-up cutting elements 280 having a smaller size than primary cutting elements 279 may also have a larger included angle of the working surface, as their impact resistance is expected to be lower. In an embodiment, primary cutting elements 279 placed along at least a blade of the tool may have a diameter of 16 mm and an included angle of the working surface of 130°, while the back-up cutting elements 280 may have a 13 mm diameter and an included angle of the working surface of 150°. In various embodiments, the cutting elements may be formed in sizes including, but not limited to, 9 mm, 13 mm, 16 mm, and 19 mm. Selection of cutting element sizes may be based, for example, on the type of formation to be drilled. For example, in softer formations, it may be desirable to use a larger cutting element, whereas in a harder formation, it may be desirable to use a smaller cutting element.

According to various embodiments, leading and back-up cutting elements may be made of materials with different properties. For example, leading cutting elements may be made of materials that have more balanced properties, such as wear and impact resistance, while the back-up cutting elements may be made of materials that exhibit greater wear resistance than the leading cutting elements. Therefore, the back-up cutting elements may perform more shearing when the leading cutting elements are worn down. However, selection of the type of material that may be used depends on the location of a leading and/or back-up cutting elements in different regions of at least a blade. For example, in one embodiment, at least one of the leading cutting elements placed on the cone region 24 of FIG. 11 is made of a material that exhibits more impact resistance (e.g., higher catalyst content), while at least one leading cutting element placed on the shoulder 25 of FIG. 11 is made of a material that exhibits more wear resistance (e.g., smaller diamond particle size). Similarly, at least one of the leading cutting elements placed on the cone region 24 of FIG. 11 is made of a material that exhibits more wear resistance (e.g., smaller diamond particle size), while at least one leading cutting element placed on the shoulder 25 of FIG. 11 is made of a material that exhibits more impact resistance (e.g., higher catalyst content). Further, when back-up cutting elements are used, it may be desirable for the back-up cutting elements to be more wear-resistant (e.g., smaller diamond particles), similar to the primary cutting elements in the nose and shoulder. Thus, one or more back-up cutting elements may be more wear resistant than one or more primary cutting elements. Specifically, for example, the back-up cutting elements may be more wear resistant than the primary cutting elements in the cone and/or gage region of the blade. Further, in various embodiments, the back-up cutting elements may be of the same wear resistance as the primary cutting elements in the nose and/or shoulder region of the blade or in some embodiments may have more wear resistance. In some embodiments, the back-up cutting elements may have less wear resistance than the primary cutting elements. One or more leading cutting elements may have a higher impact resistance than one or more of back-up cutting elements, and in some embodiments, one or more leading cutting elements may have a lower impact resistance than one or more of the back-up cutting elements.

As previously noted, the aggressiveness of a cutting tool may be tailored considering also the geometry of the cutting elements. Specifically, the included angle of the working surface of at least one cutting element, leading and/or back-up, may be varied, depending on the location of the cutting element on the blade. For example, at least one leading cutting element (e.g., a cutting element of the first plurality of cutting elements 279) may have an included angle of the working surface equal or larger than the included angle of the working surface of at least one back-up cutting element (e.g., a cutting element of the second plurality of cutting elements 280). In various embodiments, leading cutting elements may have a larger included angle, as they may be configured to withstand higher impact. As shown in FIG. 25, at least a leading cutting element 279 is sharper (having a relatively smaller included angle) than at least one back-up cutting element 280, in order to be more aggressive.

As it will be described later, at least a portion of the peripheral edge of cutting elements of the present disclosure may be beveled or chamfered. In one or more embodiments, leading and/or back-up cutting elements may be beveled or chamfered, as desired. Such a chamfer or bevel offers the potential to reduce the aggressiveness of a cutting crest upon initial engagement with the formation. In such embodiments, the cutting element bevel size may dictate the aggressiveness of a cutting tool. For example, a smaller bevel may be more aggressive but less durable. In such embodiment, the cutting elements with small bevel size may be placed in the regions of the blade that experience high stress, such as the cone region 24, while cutting elements with higher bevel size may be placed on the nose region 27 and the shoulder region 25. Various combinations may be possible depending on the type of formation.

Referring back to FIG. 16, another embodiment of the present disclosure is described. As shown in FIG. 16, similar to the embodiment presented in FIG. 12, a first plurality of leading cutting elements 279 is placed along at least one blade (primary and/or secondary as shown in FIGS. 11 and 19) of a cutting tool, in the cone region 24, nose region 27, shoulder region 25 and gage region 26. As shown, at least one of the leading cutting elements placed on the cone region 24 and at least one leading cutting element placed on the gage region 26 have the same size and the same back rake angle. Similarly, at least one of the leading cutting elements placed on the nose region 27 and on the shoulder region 25 have the same size and the same back rake angle. In order to improve the impact resistance of the leading cutting elements, at least one of leading cutting elements 279 placed on the cone and gage regions is larger in size and has a larger back rake angle than at least one of the leading cutting element placed on the nose region 27 and on the shoulder region 25, respectively. As exemplified in FIG. 16, a second plurality of back-up cutting elements 280 are placed on the same blade, rearward from and at the same radial position from the tool axis as the leading cutting elements 279. The back-up cutting elements 280 are placed on the nose region 27 and shoulder region 25, and have the same size as of the corresponding leading cutting elements 279. However, in order to improve the impact resistance of the back-up cutting elements, the back-up cutting elements placed on the nose region 27 and shoulder region 25 have a larger back rake angle than the corresponding leading cutting elements 279. In the present embodiment, the leading cutting elements 279 placed on the cone region 24 and on the gage region 26, and the back-up cutting elements 280 placed on the nose region 27 and on the shoulder region 25 may have the same back rake angle. However, other permutations of differences in back rake angle may be used between the leading cutting elements and the back-up cutting elements.

Figure 26:
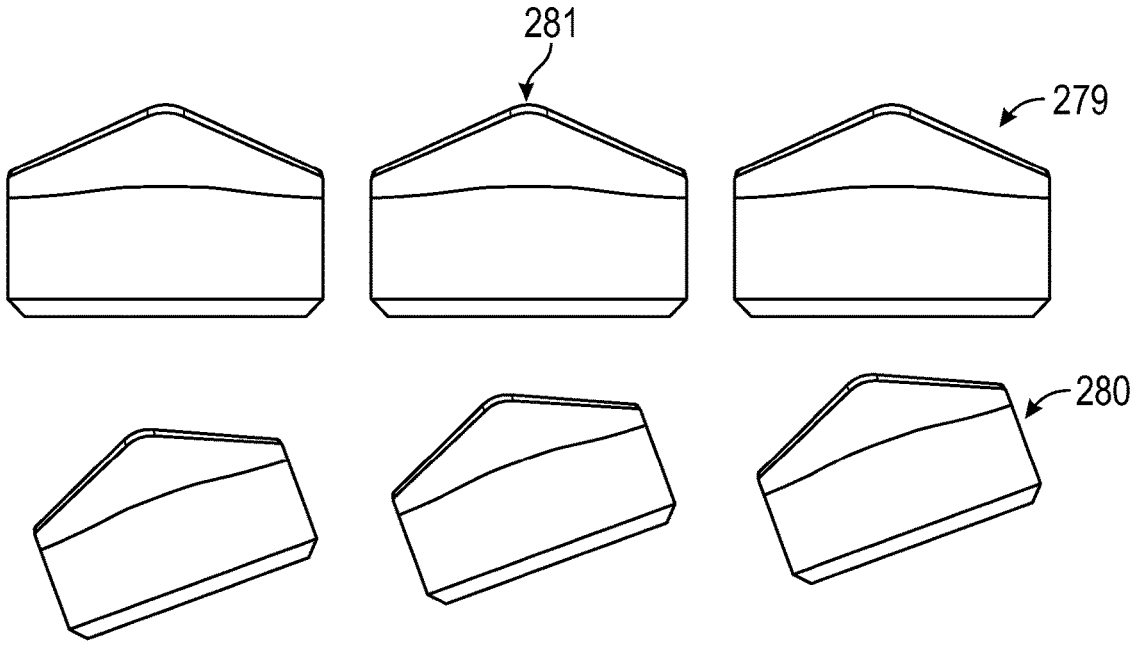

According to various embodiments, the directional control of a cutting tool may be tailored by using cutting elements with different side rake angles. For example, as shown in FIG. 26, the cutting elements 279 are larger than the size of the cutting elements 280. In addition, the back-up cutting elements 280 have a larger side rake angle than the leading cutting elements 279. As shown in FIG. 26, the cutting direction is represented by 281. As a result, the back-up non-planar cutting elements of the present embodiment may act more similar to a shear cutter providing an improved impact resistance. In one embodiment, a cutting element 279 may have a smaller side rake angle than a cutting element 280. Specifically, as illustrated, leading cutting elements 279 have a zero side rake, whereas the back-up cutting elements 280 have a non-zero side rake angle. The back-up cutting elements 280 may have either a positive or negative side rake of up to 30 degrees. While FIG. 26 shows back-up cutting elements having the same type and degree of side rake, two adjacent back-up cutting elements may have opposite types of side rake (including alternating positive and negative) and/or different values of side rake angles, similar to as described above along the blade profile. By using leading and back-up cutting elements with different side rake angles, the bit properties may be tailored towards directional control. Additionally, the back-up cutting elements may aid in breaking uncut ridges of formation formed between primary cutting elements, particularly when the larger side rake angles are on non-trailing back-up cutting elements. In addition, by including back-up cutting elements with a side rake angle, the bit vibration through different rock applications may be minimized or reduced.

Substrates according to embodiments of the present disclosure may be formed of cemented carbides, such as tungsten carbide, titanium carbide, chromium carbide, niobium carbide, tantalum carbide, vanadium carbide, or combinations thereof cemented with iron, nickel, cobalt, or alloys thereof. For example, a substrate may be formed of cobalt-cemented tungsten carbide. Ultrahard layers according to embodiments of the present disclosure may be formed of, for example, polycrystalline diamond, such as formed of diamond crystals bonded together by a metal catalyst such as cobalt or other Group VIII metals under sufficiently high pressure and high temperatures (sintering under HPHT conditions), thermally stable polycrystalline diamond (polycrystalline diamond having at least some of the catalyst material removed), or cubic boron nitride. Further, the ultrahard layer may be formed from one or more layers, which may have a gradient or stepped transition of diamond content therein. In such embodiments, one or more transition layers (as well as the other layer) may include metal carbide particles therein. Further, when such transition layers are used, the combined transition layers and outer layer may collectively be referred to as the ultrahard layer, as that term has been used in the present application. That is, the interface surface on which the ultrahard layer (or plurality of layers including an ultrahard material) may be formed is that of the cemented carbide substrate.

Non-planar Cutting Elements

Cutting elements of the present disclosure may include a substrate, an ultrahard layer, and a non-planar interface formed between the substrate and the ultrahard layer. The substrate may have an upper surface with a geometry defined by an x-y-z-coordinate system, where the height of the substrate, measured along a z-axis, varies along the x-axis and optionally y-axis. A top surface of the ultrahard layer may also have a geometry defined by the x-y-z-coordinate system, where the height of the ultrahard layer varies along the x-axis and optionally y-axis.

As noted above, the cutting elements of the present disclosure are non-planar cutting elements, namely ridge cutters. For example, a cutting element 300 of the present disclosure having a non-planar top surface 305 is shown in FIG. 3. Particularly, the cutting element 300 has an ultrahard layer 310 disposed on a substrate 320 at an interface 330, where the non-planar top surface 305 geometry is formed on the ultrahard layer 310. The ultrahard layer 310 has a peripheral edge 315 surrounding (and defining the bounds of) the top surface 305. The top surface 305 has a cutting crest 312 extending a height 314 above the substrate 320 (at the cutting element circumference), and at least one recessed region extending laterally away from crest 312. As used herein, the crest refers to a portion of the non-planar cutting element that includes the peak(s) or greatest height(s) of the cutting element, which extends along a diameter of the cutting element (which may be, but is not limited to, being linear but could be curved or having a combination of linear and curved segments). The presence of the crest 312 results in an undulating peripheral edge 315 having peaks and valleys. The portion of the peripheral edge 315 which is proximate the crest 312 forms a cutting edge portion 316. As shown, the cutting crest 312 may also extend across the diameter of the ultrahard layer, such that two cutting edge portions 316 are formed at opposite sides of the ultrahard layer. The top surface 305 further includes at least one recessed region 318 continuously decreasing in height in a direction away from the cutting crest 312 to another portion of the peripheral edge 315 that is the valley of the undulating peripheral edge 315. The cutting crest 312 and recessed regions 318 in the embodiment shown forms a top surface 305 having a parabolic cylinder shape, where the cutting crest 312 is shaped like a parabola that extends across the diameter of the ultrahard layer 310 and/or substrate 320. At least a portion of the peripheral edge (for example, the cutting edge portion and extending around the portion of the edge that will come into contact with the formation for an expected depth of cut) may be beveled or chamfered. In other embodiments, the entire peripheral edge may be beveled.

In one or more embodiments, the cutting crest 312 may extend less than the diameter of the substrate 320 or even greater than the diameter of the substrate 320. For example, the ultrahard layer 310 may form a tapered sidewall at least proximate the cutting edge portion, for example, forming an angle with a line parallel to the axis of the cutting element that may range from −5 degrees (forming a larger diameter than the substrate 320) to 20 degrees (forming a smaller diameter than the substrate 320). Depending on the size of the cutting element, the height 314 of the cutting crest 312 may range, for example, from about 0.1 inch (2.54 mm) to 0.3 inch (7.62 mm). Further, unless otherwise specified, heights of the ultrahard layer (or cutting crests) are relative to the lowest point of the interface of the ultrahard layer and substrate.

FIG. 4 shows a side view of the cutting element 300. As shown, the cutting crest 312 has a convex cross-sectional shape (viewed along a plane perpendicular to cutting crest length across the diameter of the ultrahard layer), where the uppermost point of the crest has a radius of curvature 313 that transitions to opposite side surfaces at an angle 311. According to embodiments of the present disclosure, a cutting element top surface may have a cutting crest with a radius of curvature ranging from 0.02 in. (0.51 mm) to 0.300 in. (7.62 mm), or in another embodiment, from 0.06 in. (1.52 mm) to 0.18 in. (4.57 mm). Further, while the illustrated embodiment shows a cutting crest 312 having a curvature at its upper peak, it is also within the scope of the present disclosure that the cutting crest 312 may have a plateau or a substantially planar face along at least a portion of the diameter, axially above the recessed regions 318 laterally spaced from the cutting crest 312. Thus, in such an embodiment, the cutting crest may have a substantially infinite radius of curvature. In such embodiments, the plateau may have radiused transitions into the sidewalls that extend to form recessed regions 318. Further, in some embodiments, along a cross-section of the cutting crest 312 extending laterally into depressed regions 318, cutting crest 312 may have an included angle at the working surface 311 formed between the sidewalls extending to recessed regions 318 that may range from 100 degrees to 175 degrees. Further, depending on the type of upper surface geometry, it is also intended that other crest angles, including down to 90 degrees may also be used.

Figure 5:
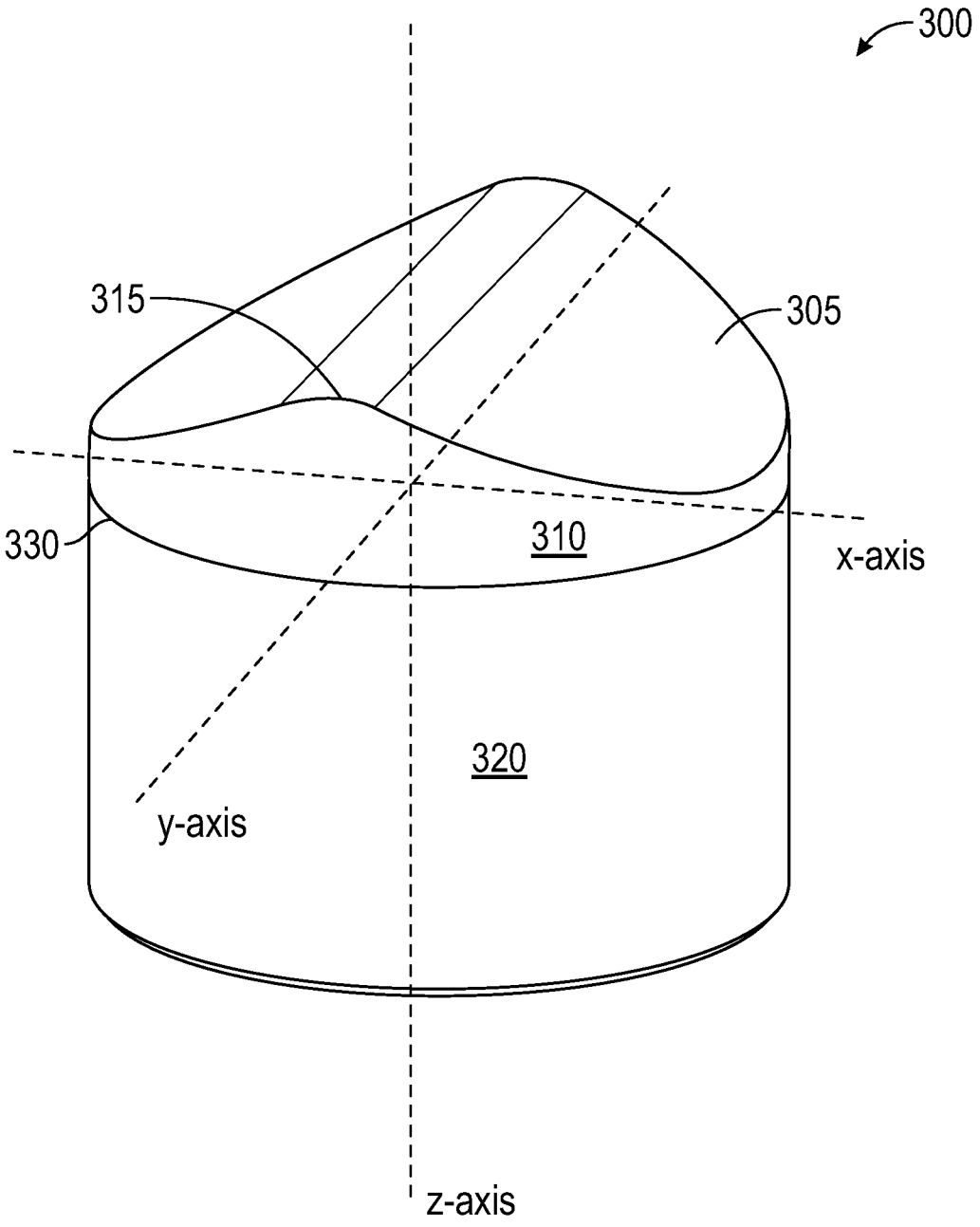
FIG. 5 shows a perspective view of the cutting element shown in FIG. 3.
Figure 6:
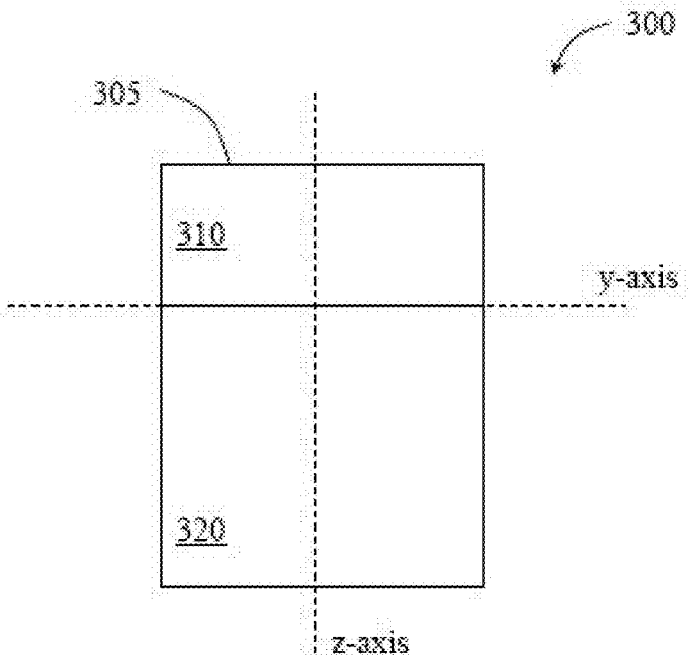
FIGS. 6 and 7 show a cross-sectional view of a cutting element top surface according to embodiments of the present disclosure.
Figure 7:
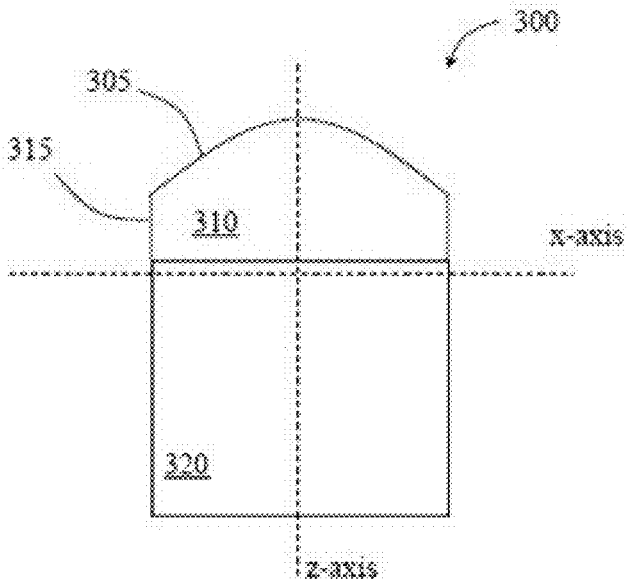

The geometry of a cutting element top surface may also be described with respect to an x-y-z coordinate system. For example, the cutting element shown in FIG. 3 is reproduced in FIG. 5 along an x-y-z coordinate system. The cutting element 300 has an ultrahard layer 310 disposed on a substrate 320 at an interface 330, and a longitudinal axis coinciding with the z-axis extending there through. The non-planar top surface 305 formed on the ultrahard layer 310 has a geometry formed by varying heights (wherein the height is measured along the z-axis) along the x-axis and y-axis. As shown, the greatest height (apex or peak) formed in the top surface (which may also be referred to as the cutting crest 312 in FIG. 3) extends across the diameter of the cutting element along the y-axis, such that the crest height extends from a first portion of the peripheral edge 315 to a second portion of the peripheral edge 315 opposite from the first portion. From the sake of convenience, the y-axis is defined based on the extension of the cutting element crest; however, one skilled in the art would appreciate that if defined differently, the remaining description based on the x-, y-, z-coordinate system would similarly vary. A cross-sectional view of the cutting element 300 along the intersection of the y-axis and z-axis is shown in FIG. 6. The y-z cross-sectional view of the cutting element may be referred to as the crest profile view as the uniformity, extension, etc., of the crest may be observed from such a cross-sectional view. As shown in the crest-profile view in FIG. 6, the top surface 305 along the crest height (i.e., crest profile) is substantially linear. While the cutting crest could be linear, as shown in this embodiment, it could also be curved or radiused. A cross-sectional view of the cutting element 300 along the intersection of the x-axis and the z-axis is shown in FIG. 7, and may be referred to as the crest geometry view, as the curvature, etc., of the crest may be observed from such a cross-sectional view. As shown in the crest geometry view in FIG. 7, the top surface 305 peaks at the z axis (at the crest height), and continuously decreases from the crest height, moving along the x-axis in either direction towards the peripheral edge 315 of the cutting element (which may also be referred to as the recessed regions 318 in FIG. 3), such that the top surface 305 has a generally parabolic shape along the cross-section. Depending on the curvature of the cross-section illustrated in FIG. 7, the cross-section may also be described as the cross-section of a cone with a rounded apex, i.e., two angled sidewalls tangentially transitioning into the rounded apex (having the radius of curvature ranges described above). However, sidewalls with curvature, either concave or convex, may also be used. In this illustrated embodiment, the generally parabolic shape in the x-z cross-sectional view (or crest geometry view) extends along the y-axis, such that the three dimensional shape of the non-planar top surface 305 has parabolic cylinder shape.

Figure 9:
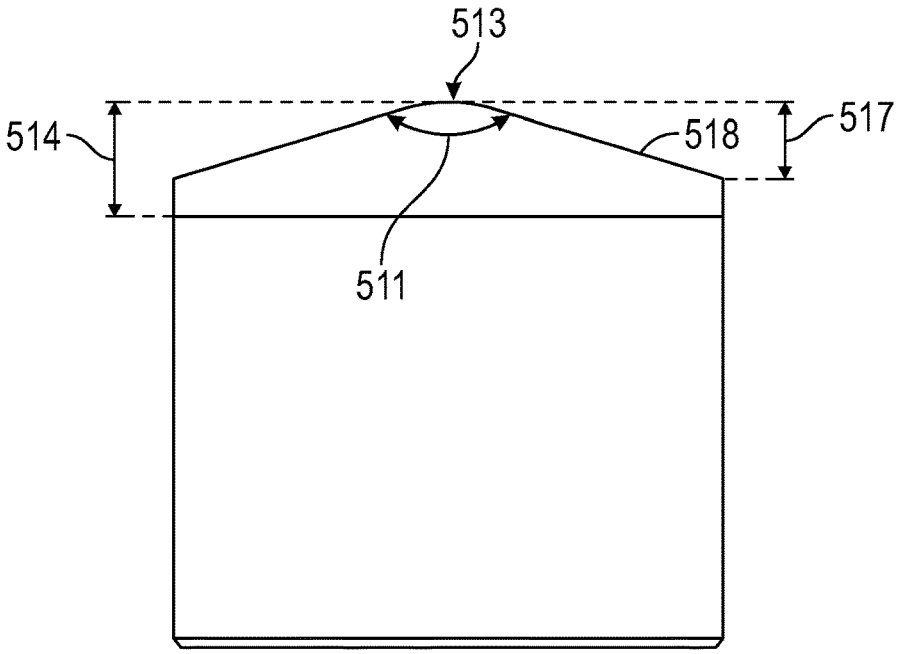

FIGS. 8 and 9 show another example of a cutting element 500 having a non-planar top surface 505. The cutting element 500 has an ultrahard layer 510 disposed on a substrate 520 at an interface 530, wherein the non-planar top surface 505 is formed on the ultrahard layer 510. The ultrahard layer 510 has a peripheral edge 515 surrounding the top surface 505. The top surface 505 has a cutting crest 512 extending a height 514 above the substrate 520, and at least one recessed region 518 extending laterally from crest 512. The crest 512, proximate a portion of the peripheral edge 515, forms a first cutting edge portion 516. As shown in FIG. 9, the cutting crest 512 of a non-planar cutting element of the present disclosure has a radius of curvature 513 that transitions to opposite side surfaces at an angle 511 called included angle of the working surface. The peripheral edge 515 may be undulating from a peak at the cutting edge portion 516, and a valley proximate at least one recessed region 518, which continuously decreases in height in a direction away from the crest 512. As shown in FIG. 9, the recessed regions 518 extends a height above the substrate/ultrahard layer interface (along the circumference), but may have a height differential 517 (from the cutting edge portion 516), which is also equal to the total variation in height of the top surface 505. According to some embodiments, a non-planar top surface of a cutting element may have a height differential 517 ranging between 0.04 in (1.02 mm) and 0.2 in (5.08 mm) depending on the overall size of the cutting element. For example, the height differential 517 relative to the cutting element diameter may range from 0.1 to 0.5, or from 0.15 to 0.4 in other embodiments. Additionally, in one or more embodiments, the height of the diamond at the peripheral edge adjacent recessed region 518 (i.e., at the side of the cutting element having the lowest diamond height) may be at least 0.04 in. (1.02 mm).

Advantageously, embodiments disclosed herein may provide for at least one of the following. The various geometries and placement of the non-planar cutting elements may provide for optimized use of the non-planar cutting elements during use, specifically, to reduce or minimize harmful loads and stresses on the cutting elements during drilling. By placing non-planar cutting elements with different material properties, sizes, orientations, and/or working surface geometries in areas of a cutting tool experiencing increased wear, the wear rate of the bit may be improved. In addition, non-planar cutting elements having side rake angles may provide better impact resistance to the cutting element. Furthermore, by using leading and back-up cutting elements with different side rake angles, the cutting tool properties may be tailored towards directional control. In addition, the bit vibration through different rock applications may be minimized. Cutting tools according to the present embodiments may offer the potential for controlled aggressiveness along the entire blade profile, and therefore may exhibit higher cutting efficiency and longer life time than conventionally cutting tools.

While embodiments of this disclosure have been described in detail with particular references to embodiments thereof, the embodiments described herein are not intended to be exhaustive or to limit the scope of the disclosure to the exact forms disclosed. Persons skilled in the art and technology to which this invention pertains will appreciate that alterations and changes in the described structures and methods of assembly and operation can be practiced without meaningfully departing from the principles, spirit, and scope of this disclosure. Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein.

Additionally, as used herein, the term "substantially" and similar terms are used as terms of approximation and not as terms of degree, and are intended to account for the inherent deviations in measured or calculated values that would be recognized by those of ordinary skill in the art. Furthermore, as used herein, when a component is referred to as being "on" or "coupled to" another component, it can be directly on or attached to the other component or intervening components may be present therebetween. It should be understood that any directions or reference frames in the preceding description are merely relative directions or movements. For example, any references to "up" and "down" or "above" and "below" are merely descriptive of the relative position or movement of the related elements.

In the claims, means-plus-function clauses are intended to cover the structures described herein as performing the recited function and not just structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke means-plus-function for any limitations of any of the claims herein, except for those in which the claim expressly uses the words 'means for' together with an associated function.

What is claimed is:

1. A downhole cutting tool, comprising:

a tool body;

at least one blade extending from the tool body, the at least one blade having a cutting face, a trailing face, and a top face extending between the cutting face and trailing face; and a plurality of cutting elements attached to the at least one blade along the cutting face, wherein each cutting element of the plurality of cutting elements comprises a diamond table and a substrate, a working surface of each of the plurality of cutting elements having a cutting crest at a peak height and a reduced height extending laterally away from the cutting crest, the working surface being opposite the substrate, at least two of the plurality of cutting elements on the at least one blade having differing material properties along a blade profile of the at least one blade, wherein the differing material properties consist of the diamond tables having an average diamond grain size between 1 to 40 microns, a binder content by weight between 1% to 15%, or any combination thereof, and a first cutting element of the at least two comprises a diamond table having an average diamond grain size of 3 microns or less and a binder content by weight of 2% or less.

2. The downhole cutting tool of claim 1, wherein the plurality of the cutting elements is placed on a cone region, a nose region, a shoulder region, or a gage region of the at least one blade.

3. The downhole cutting tool of claim 2, wherein a size of at least one of the plurality of cutting elements placed on the cone and the gage regions is larger than a size of at least one of the plurality of cutting elements placed on the nose and shoulder regions of the tool body.

4. The downhole cutting tool of claim 2, wherein an included angle of the working surface of at least one of the plurality of cutting elements placed on the cone region is larger than an included angle of the working surface of at least one of the plurality of cutting elements placed on the nose or shoulder regions of the tool body.

5. The downhole cutting tool of claim 2, wherein at least one of the plurality of cutting elements in the cone region has a greater back rake angle than at least one of the plurality of cutting elements in the nose or shoulder region.

6. The downhole cutting tool of claim 2, wherein the cutting element in the cone region is larger than the cutting element in the nose or shoulder region.

7. The downhole cutting tool of claim 2, wherein the cutting element in the gage region is larger than the cutting element in the nose and/or shoulder region.

8. The downhole cutting tool of claim 2, wherein a radius of curvature at the crest of at least one of the plurality of cutting elements placed on the cone region of the tool body is larger than a radius of curvature at the crest of at least one of the plurality of cutting elements placed on the nose or shoulder regions of the tool body.

9. The downhole cutting tool of claim 1, wherein the at least two of the plurality of cutting elements have different back rake angles or different side rake angles.

10. The downhole cutting tool of claim 9, wherein the plurality of the cutting elements is placed on a cone region, a nose region, a shoulder region, or a gage region of the at least one blade, and wherein a cutting element in the gage region has a larger back rake angle than a cutting element in the nose or shoulder region.

11. The downhole cutting tool of claim 1, wherein the at least two cutting elements have a different angle formed between a line extending through the crest and a cutting profile curve that is tangent to the plurality of cutting elements.

12. The downhole cutting tool of claim 1, wherein a second cutting element of the plurality of cutting elements comprises a second diamond table having an average diamond grain size between 30 to 40 microns and binder content by weight between 10% to 15%.

13. The downhole cutting tool of claim 12, wherein the first cutting element is further from a tool axis of the tool body on the at least one blade than the second cutting element.

14. A downhole cutting tool, comprising:

a tool body having a tool axis;

at least one blade extending from the tool body, the at least one blade having a cutting face, a trailing face, and a top face extending between the cutting face and trailing face; and a plurality of cutting elements attached to the at least one blade along the cutting face, wherein each cutting element of the plurality of cutting elements comprises a diamond table and a substrate, a working surface of each of the plurality of cutting elements having a cutting crest at a peak height and a reduced height extending laterally away from the cutting crest, the working surface being opposite the substrate, a first of the plurality of cutting elements closer to the tool axis than a second of the plurality of cutting elements having a greater impact resistance than the second of the plurality of cutting elements, wherein the first plurality of cutting elements comprises the diamond tables having an average grain size between 30 to 40 microns inclusive, the second plurality of cutting elements comprises the diamond tables having an average grain size less than 3 microns and a binder content by weight of 2% or less.

15. The downhole cutting tool of claim 14, wherein the plurality of the cutting elements is placed on a cone region, a nose region, a shoulder region, or a gage region of the at least one blade.

16. The downhole cutting tool of claim 15, wherein the size of at least one of the plurality of cutting elements placed on the cone or the gage region is larger than the size of at least one of the plurality of cutting elements placed on the nose and/or shoulder regions of the tool body.

17. The downhole cutting tool of claim 15, wherein an included angle of the working surface of at least one of the plurality of cutting elements placed on the cone region is larger than an included angle of the working surface of at least one of the plurality of cutting elements placed on the nose and/or shoulder regions of the tool body.

18. The downhole cutting tool of claim 14, wherein the at least two of the plurality of cutting elements have different back rake angles or different side rake angles.

19. The downhole cutting tool of claim 14, wherein a radius of curvature at the crest of at least one of the plurality of cutting elements placed on the cone region of the tool body is larger than a radius of curvature at the crest of at least one of the plurality of cutting elements placed on the nose or shoulder regions of the tool body.

20. A downhole cutting tool, comprising:

a tool body having a tool axis;

at least one blade extending from the tool body, the at least one blade having a cutting face, a trailing face, and a top face extending between the cutting face and trailing face; and a plurality of cutting elements attached to the at least one blade along the cutting face, wherein each cutting element of the plurality of cutting elements comprises a diamond table and a substrate, a working surface of each of the plurality of cutting elements having a cutting crest at a peak height and a reduced height extending laterally away from the cutting crest, the working surface being opposite the substrate, a first of the plurality of cutting elements further from the tool axis than a second of the plurality of cutting elements having a greater wear resistance than the second of the plurality of cutting elements, wherein the first of the plurality of cutting elements comprises the diamond tables having a binder content by weight of less than or equal to 2%, a first cutting element of the plurality of cutting elements comprises a first diamond table having an average diamond grain size of less than or equal to 3 microns, and the second of the plurality of cutting elements comprises the diamond tables having a binder content by weight between 10 to 15% inclusive.

* * * * *